US005954896A

United States Patent [19]

Koyama et al.

[11] Patent Number: 5,954,896

[45] **Date of Patent: *Sep. 21, 1999**

[54] COLD ROLLED STEEL SHEET AND GALVANIZED STEEL SHEET HAVING IMPROVED HOMOGENEITY IN WORKABILITY AND PROCESS FOR PRODUCING SAME

[75] Inventors: Kazuo Koyama; Masayoshi Suehiro; Naoki Yoshinaga; Natsuko Hashimoto, all of Futtsu, Japan

[73] Assignee: Nippon Steel Corporation, Tokyo, Japan

[ * ] Notice: This patent is subject to a terminal disclaimer.

[21] Appl. No.: 08/737,107

[22] PCT Filed: Dec. 28, 1995

[86] PCT No.: PCT/JP95/02768

§ 371 Date: Oct. 18, 1996

§ 102(e) Date: Oct. 18, 1996

[87] PCT Pub. No.: WO96/26300

PCT Pub. Date: Aug. 29, 1996

[30] Foreign Application Priority Data

Feb. 23, 1995 [JP] Japan ..... 7-035743
Apr. 17, 1995 [JP] Japan ..... 7-091180

[51] Int. Cl.[6] ..... C21D 8/02

[52] U.S. Cl. ..... 148/533; 148/603; 420/126; 420/127

[58] Field of Search ..... 148/533, 602, 148/603; 420/87, 88, 126, 127

[56] References Cited

U.S. PATENT DOCUMENTS

| | | | |
|---|---|---|---|
| 4,473,414 | 9/1984 | Irie et al. | 420/127 |
| 5,133,815 | 7/1992 | Hashimoto et al. | 420/126 |
| 5,356,493 | 10/1994 | Tsuyama et al. | 420/126 |
| 5,690,755 | 11/1997 | Yoshinaga et al. | 148/603 |
| 5,846,343 | 12/1998 | Yasuhara et al. | 173/603 |

FOREIGN PATENT DOCUMENTS

| | | | |
|---|---|---|---|
| 59-197526 | 11/1984 | Japan . | |
| 1-91748 | 8/1989 | Japan . | |
| 3-150371 | 6/1991 | Japan . | |
| 3-294463 | 12/1991 | Japan . | |
| 6-65647 | 3/1994 | Japan | 148/603 |

OTHER PUBLICATIONS

Katsumi Yamada, "Precipitation Behavior of Ti–S–C in Ultra–Low–Carbon Steels," Material and Process 6(6) (1993) Katsumi Yamada, Masakazu Niikura P. 1710.

*Primary Examiner*—George Wyszomierski
*Attorney, Agent, or Firm*—Kenyon & Kenyon

[57] ABSTRACT

According to the present invention, an ultra low carbon steel with Nb, Ti, or Nb-Ti added thereto is used as a material, and (% S as MnS)/(total S content) is regulated to not more than 0.2 with (% C as carbosulfide)/(total C content) being regulating to not more than 0.7, thereby efficiently precipitating carbosulfide in a γ temperature region during hot rolling and thus reducing the amount of C in solid solution to ensure the homogeneity of the material over the whole length of a coil and to markedly improve the workability.

9 Claims, 4 Drawing Sheets

COLD ROLLED STEEL SHEET AND GALVANIZED STEEL SHEET HAVING IMPROVED HOMOGENEITY IN WORKABILITY AND PROCESS FOR PRODUCING SAME

TECHNICAL FIELD

The present invention relates to a cold rolled steel sheet and a galvanized steel sheet, for use in automobiles, domestic electric appliances, building materials and the like, and a process for producing the same and, in particular, a process for producing said steel sheets from a cold rolled steel strip or a galvanized steel strip having improved homogeneity in workability.

BACKGROUND ART

Ultra low carbon steel sheets, by virtue of excellent workability, have been extensively used in applications such as automobiles (Japanese Unexamined Patent Publication (Kokai) No. 58-185752).

In order to further improve the workability, various studies have been made on the compositions of ultra low carbon steels and their production processes.

For example, Japanese Unexamined Patent Publications (Kokai) No. 3-130323, No. 4-143228, and No. 4-116124 disclose that excellent workability can be provided by minimizing the content of C, Mn, P and other elements in an ultra low carbon steel with Ti added thereto. In the inventions described therein, however, no mention is made of an improvement in the yield in the end portions in the widthwise direction and longitudinal direction of the steel strip (coil). Further, the techniques disclosed therein, unlike the technique according to the present invention, do not positively utilize Ti and Nb carbosulfides, Ti carbide and the like.

Japanese Unexamined Patent Publications (Kokai) No. 3-170618 and No. 4-52229 describe a reduction in a variation of properties of materials. According to the inventions described herein, however, the reduction ratio in finish hot rolling should be large, and, at the same time, an enhanced coiling temperature after the hot rolling is necessary, resulting in application of large load to the step of hot rolling.

The effect of the present invention can be attained also in P- or Si-strengthened high-strength cold rolled steel sheets possessing good workability. Representative techniques on these steel sheets are disclosed in, for example, Japanese Unexamined Patent Publication (Kokai) Nos. 59-31827 and 59-38337, Japanese Examined Patent Publication (Kokoku) No. 57-57945, and Japanese Unexamined Patent Publication (Kokai) No. 61-276931. In these techniques, however, no device for improving the yield in the end portions in the widthwise direction and longitudinal direction of the coil is provided. Further, the techniques disclosed therein, unlike the technique according to the present invention, do not positively utilize Ti and Nb carbosulfides.

For ultra low carbon steels with Ti or a combination of Ti and Nb added thereto, it is common practice to coil a steel strip, after hot rolling, at an elevated temperature. According to this method, the coiling at an elevated temperature causes C to be precipitated as TiC or NbC, resulting in reduced C in solid solution, which in turn ensures good properties after cold rolling and annealing. Since, however, the end portions in the widthwise direction and the end portions in the longitudinal direction of hot rolled coils are very rapidly cooled during and after coiling, the precipitation of TiC and NbC is unsatisfactory, leading to deteriorated properties in these portions. For this reason, in fact, the end portions of hot rolled sheets or cold rolled sheets are, in many cases, cut off, increasing the production cost of the ultra low carbon steel.

DISCLOSURE OF THE INVENTION

An object of the present invention is to solve the above problems and to provide a cold rolled steel sheet which has been improved in homogeneity in workability, that is, is much less likely to cause a deterioration of properties in the end portions in the widthwise direction and longitudinal direction of the coil.

In the prior art, the amount of C, M, N, P and other elements added has been minimized from the viewpoint of improving the absolute value of indexes of workability, such as elongation and r value. However, no studies have been made on a reduction in the amount of C in solid solution by taking advantage of the precipitation of carbosulfide in a $\gamma$ region, and the amount of C in solid solution has hitherto been reduced by precipitating carbides, such as TiC and NbC, during coiling. In this technique, in order to reduce the variation of properties within the coil, it is necessary to increase the reduction ratio in the finish hot rolling, to conduct coiling at an elevated temperature (about 700–800° C.), or to use a U-shaped coiling temperature pattern, resulting in increased load on the step of hot rolling. Further, such a technique could not have imparted satisfactory homogeneity in workability to steel sheets.

Accordingly, the present inventors have made extensive and intensive studies with a view to developing a cold rolled steel sheet having improved properties and, as a result, have found that, to attain this object, it is very important to positively precipitate carbosulfide in the step of hot rolling to minimize the amount of C in solid solution.

Specifically, in an ultra low carbon steel, in order to positively utilize S contained in the steel, the Mn content is regulated to minimize the amount of S precipitated as MnS, and most of the S contained in the steel is used to positively precipitate carbosulfides, such as Nb-containing carbosulfide, Ti-containing carbosulfide, or Nb-Ti-containing carbosulfide, in the step of hot rolling, thereby minimizing the amount of C in solid solution before coiling. By virtue of this technique, since C in solid solution is satisfactorily fixed before coiling, even when the end portions of the coil are rapidly cooled during coiling after hot rolling, a deterioration in properties of the material attributable to the presence of a large amount of C in solid solution remaining unfixed and to the precipitation of a fine carbide can be reduced.

That is, reducing the amount of C in solid solution before coiling reduces a variation in properties of the material within the coil, resulting in reduced dependency of the properties of the material upon coiling temperature.

For the precipitation of the carbosulfides in a large amount to homogenize properties within the coil, it is necessary to incorporate 0.004 to 0.02% by weight of S and 0.01 to 0.15% by weight of Mn in an ultra low carbon steel, having a carbon content of 0.0005 to 0.007% by weight, with Nb or Nb-Ti added thereto. Further, in the case of the addition of Nb or Nb-Ti, after coiling following the hot rolling, the proportion K of the amount of S precipitated as MnS to the content of S in the steel, that is, K=(% S as MnS)/(S content) should be not more than 0.2, and the proportion L of the amount of C precipitated as carbosulfide to the content of C in the steel, that is, L=(% C as carbosulfide)/(C content) should be not less than 0.7, while in the case of the addition of Ti alone, the following requirements should be satisfied: $K \leqq 0.2$ and $Ti^*/S \geqq 1.5$, wherein $Ti^*=Ti-3.42\ N$.

Specifically, in an ultra low carbon steel with Ti added thereto, when S is dissolved in a solid solution form in the above range, a Ti-containing carbosulfide, $Ti_4C_2S_2$, is precipitated in a γ region during hot rolling. Studies conducted by the present inventors have revealed that, also in the case of the addition of Nb, a Nb-containing carbosulfide corresponding to $Ti_4C_2S_2$, for example, $Nb_4C_2S_2$, is precipitated in the γ region under the same conditions. Further, it has been confirmed that, also in the case of the addition of Ti in combination with Nb, a precipitate, wherein a part of Ti in $Ti_4C_2S_2$ has been replaced with Nb, for example, $(TiNb)_4C_2S_2$, is precipitated in the γ region under the same conditions.

The precipitation of the Nb-containing carbosulfide or the Ti-Nb-containing carbosulfide in a γ region is a novel finding. Further, it has been found that, in the case of the addition of Ti alone, when $Ti^*/S$, wherein $Ti^*=Ti-3.42\ N$, is brought to not less than 1.5, the amount of the TiS produced is markedly reduced and, in this case, most of the Ti-containing carbide produced in the γ region is $Ti_4C_2S_2$. Therefore, hot rolling in a temperature region of 1250° C. or below corresponding to the γ region to precipitate the carbosulfide, thereby reducing the amount of C in solid solution within the steel sheet, is very effective in improving the workability of the ultra low carbon steel sheet.

Thus, the subject matter of the present invention is as follows. In the following description, all "%" are by weight.

The present invention provides a cold rolled steel sheet possessing improved homogeneity in workability, characterized by comprising C: 0.0005 to 0.007%, Mn: 0.01 to 0.15%, Si: 0.005 to 0.8%, Al: 0.005 to 0.1%, P: not more than 0.2%, S: 0.004 to 0.02%, N: not more than 0.007%, and, in the case of the incorporation of Nb alone, Nb: 0.005 to 0.1% and, in the case of the incorporation of Nb-Ti, Nb: 0.002 to 0.05% and Ti: 0.01 to 0.1%, and, in the case of the incorporation of Ti, Ti: 0.01 to 0.1% while satisfying $Ti^*/S \geqq 1.5$ wherein $Ti^*=Ti-3.42\ N$, and optionally B: 0.0001 to 0.0030%, with the balance consisting of iron and unavoidable impurities, the proportion K of the amount of S precipitated as MnS to the total S content, K=(% S as MnS)/(total S content), being not more than 0.2 and the proportion L of the amount of C precipitated as Nb- and/or Ti-containing carbosulfide to the total C content, L=(% C as carbosulfide)/(total C content), being not less than 0.7; and a process for producing a cold rolled steel sheet or a galvanized, cold rolled steel sheet, characterized by comprising the steps of: hot rolling a steel having the above composition under conditions of heating temperature $\leqq$1250° C. and finishing temperature $\geqq (Ar_3-100)$° C.; coiling the hot rolled strip in the temperature range of from 800° C. to room temperature; cold-rolling the hot rolled steel strip with a reduction ratio of not less than 60%; and then annealing the cold rolled steel strip at the recrystallization temperature or above, or characterized by comprising the steps of: after the cold rolling, passing the cold rolled steel strip into a continuous galvanizing line, where the cold rolled steel strip is annealed, in an annealing furnace provided within the line, at the recrystallization temperature or above; galvanizing the steel strip in the course of cooling; and optionally alloying the steel strip.

BRIEF DESCRIPTION OF THE DRAWINGS

FIG. 1 (2) is a diagram showing the relationship between the dependency of r value upon coiling temperature and L value in the case of the addition of Nb alone;

FIG. 2 (2) is a diagram showing the relationship between the dependency of r value upon coiling temperature and L value in the case of the addition of a combination of Ti and Nb;

FIG. 3 (2) is a diagram showing the relationship between the dependency of r value upon coiling temperature and $Ti^*/S$ value in the case of the addition of Ti alone.

BEST MODE FOR CARRYING OUT THE INVENTION

Figure 1:
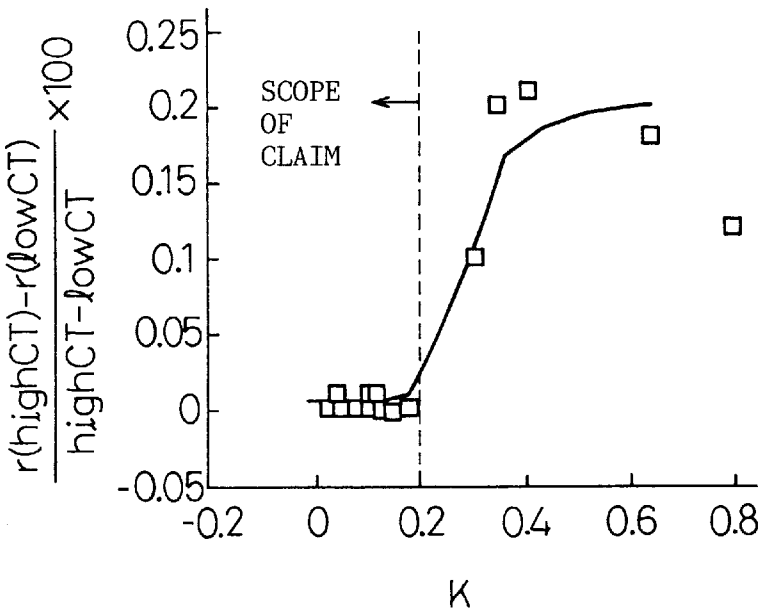
FIG. 1 (1) is a diagram showing the relationship between the dependency of r value upon coiling temperature and K value in the case of the addition of Nb alone.
Figure 1:
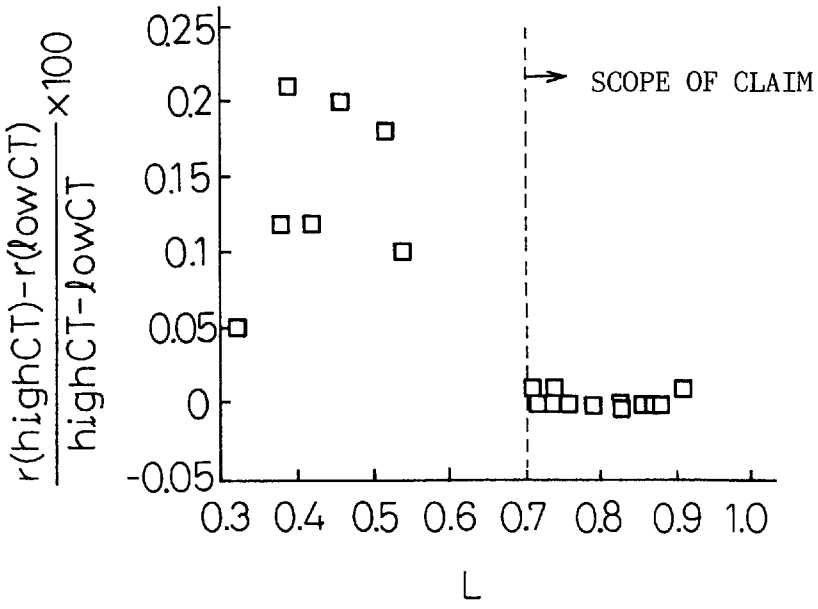

According to the present invention, the contents of S, Mn, Nb, Ti and other elements as elements added to an ultra low carbon steel are specified so as to satisfactorily precipitate particular carbosulfides and to thereby reduce, before coiling, the amount of C in solid solution within a coil to not more than 30% of the amount of C added, reducing a deterioration in properties of the material attributable to the presence of a large amount of C in solid solution remaining unfixed and to the precipitation of a fine carbide in the widthwise direction and the longitudinal direction of the coil and thus markedly homogenizing the workability of the cold rolled steel sheet. Additive elements, carbosulfides precipitated, production process and the like will be described.

At the outset, the reasons for the limitation of chemical compositions of a steel in the present invention will be described.

An increase in the amount of C added to a steel, makes it necessary to increase the amount of carbosulfide formers for fixing C, such as Nb and S, resulting in increased cost, and, further, causes C in solid solution to remain in the end portions of a hot rolled coil and causes a large number of TiC, NbC and other fine carbides, besides carbosulfides, to be precipitated within grains, inhibiting grain growth and, hence, deteriorating the workability of the cold rolled steel sheet. For the above reason, the C content is limited to not more than 0.007% with a C content of not more than 0.003% being preferred. The lower limit of the C content is 0.0005% from the viewpoint of vacuum degassing cost.

Si is useful as an inexpensive strengthening element and, hence, is utilized according to the contemplated strength level. However, when the Si content exceeds 0.8%, YP rapidly increases, resulting in lowered elongation and remarkably deteriorated plating property. Therefore, the Si content is limited to not more than 0.8%. When galvanizing is contemplated, the Si content is preferably not more than 0.3% from the viewpoint of plating property. When the steel sheet is not required to have high strength (TS: not less than 350 MPa), the Si content is still preferably not more than 0.1%. The lower limit thereof is 0.005% from the viewpoint of steelmaking cost.

Mn is one of the most important elements in the present invention. Specifically, when the Mn content exceeds 0.15%, the amount of MnS precipitated is increased, and, consequently, the amount of S is reduced, leading to reduced amount of carbosulfides containing Nb or the like. Therefore, even in the case of coiling at an elevated temperature, since the cooling rate in the end portions of the hot rolled coil is so high that a larger amount of C in solid solution remains unfixed, or otherwise a number of fine carbides are precipitated, resulting in remarkably deteriorated properties of the material. For the above reason, the Mn content is limited to not more than 0.15%, preferably less than 0.10%. On the other hand, when the Mn content is less than 0.01%, no particular effect can be attained and, at the same time, the steelmaking cost is increased. Therefore, the lower limit of the Mn content is 0.01%.

P, as with Si, is useful as an inexpensive strengthening element and positively used according to the contemplated strength level. However, a P content exceeding 0.2% is causative of cracking at the time of hot or cold rolling and, at the same time, deteriorates the formability and alloying speed of the galvanizing. Therefore, the P content is limited to not more than 0.2%, more preferably not more than 0.08%. When the steel sheet is not required to have high strength, the P content is more preferably not more than 0.03%.

S is a very important element in the present invention, and the content thereof is 0.004 to 0.02%. When the S content is less than 0.004%, the amount of carbosulfides containing Nb or the like is unsatisfactory. In the case of coiling at an elevated temperature and, of course, in the case of coiling at a low temperature, in the end portion of the coil, a large amount of C in solid solution remains unfixed, or otherwise NbC is finely precipitated, inhibiting grain growth during annealing and, hence, remarkably deteriorating the workability. On the other hand, when the S content exceeds 0.02%, hot tearing is likely to be created and, at the same time, MnS is precipitated in a larger amount than carbosulfides containing Nb or the like, posing a similar problem. Therefore, the homogeneity in workability cannot be ensured. The S content is more preferably 0.004 to 0.012%.

Al should be added as a deoxidizer in an amount of at least 0.005%. An Al content exceeding 0.1%, however, leads to an increase in cost and, further results in increased amount of inclusions, deteriorating the workability.

N, as in the case of C, with an increase in the amount thereof added to the steel, makes it necessary to increase the amount of Al as a nitride former, resulting in increased cost and, due to increased precipitate, deteriorated ductility. Therefore, the lower the N content, the better. For the above reason, the N content is limited to not more than 0.007%, preferably not more than 0.003%.

Nb is the most important element in the present invention. It precipitates as a Nb-containing carbosulfide (for example, $Nb_4C_2S_2$) and, further, functions to refine the grain size of the hot rolled sheet, improving the deep drawability. When Nb is added alone, the anisotropy of r value, $\Delta r$, is very small and not more than 0.2, resulting in markedly improved powdering resistance in galvanizing. For this reason, when Nb is added alone, the amount of Nb added is 0.005 to 0.1%. When the amount of Nb added is less than 0.005%, the Nb-containing carbosulfide cannot be precipitated prior to coiling. On the other hand, when it exceeds 0.1%, the effect of fixing C is saturated and, further, the ductility is remarkably deteriorated. From the above fact, the Nb content is more preferably 0.02 to 0.05%.

Ti, when used alone, is added in an amount of 0.01 to 0.1%. When the Ti content is less than 0.01%, the Ti-containing carbosulfide, $Ti_4C_2S_2$, cannot be precipitated prior to coiling. On the other hand, when the Ti content exceeds 0.1%, the effect of fixing C is saturated and, further, it is difficult to ensure the peeling resistance of the plating high enough to withstand press molding. The addition of Ti in an amount exceeding 0.025% is preferred from the viewpoint of satisfactorily precipitating $Ti_4C_2S_2$.

Further, the relationship between the Ti content and the S content is important, and the following requirement should be satisfied: $Ti^*/S \geqq 1.5$ wherein $Ti^*=Ti-3.42\ N$. In the case of a $Ti^*/S$ of less than 1.5, the precipitation of $Ti_4C_2S_2$ is unsatisfactory, and TiS and MnS are precipitated in a large amount, making it difficult to precipitate C before coiling after hot rolling. In this case, in the end portions of the hot rolled sheet, even coiling at an elevated temperature causes a large amount of C in solid solution to remain unfixed, or otherwise a fine carbide is precipitated, resulting in extremely deteriorated properties of the material. Preferably, the $Ti^*/S$ value exceeds 2, and, when a better effect is desired, is more preferably not less than 3.

When Nb and Ti are added in combination, the amount of Nb added is 0.002 to 0.05% with the amount of Ti added being 0.01 to 0.1%.

When the Nb content and the Ti content are less than the above respective lower limit values, a Nb-Ti-containing carbosulfide cannot be precipitated prior to coiling. On the other hand, they each exceed 0.05%, the effect of fixing C is saturated and, at the same time, in the case of Nb, the ductility is remarkably deteriorated, while, in the case of Ti, it is difficult to ensure a peeling resistance of the plating high enough to withstand press molding.

The addition of Ti in an amount exceeding 0.02% is more preferred from the viewpoint of satisfactorily precipitating carbosulfides containing Ti and Nb. Further, the addition of Ti in an amount of not more than 0.05% is more preferred from the viewpoint of a plating property.

In the above chemical composition, in order to precipitate the carbosulfide in a large amount, the K value should be specified to be not more than 0.2, and, in addition, in the case of a steel with Ti added alone thereto, $Ti^*/S$ should be specified to be not less than 0.15. Further, in order to provide satisfactory homogeneity of the workability, in the case of a steel with Nb added thereto and a steel with a combination of Nb and Ti added thereto, the L value should be not less than 0.7.

For various steels, the r value was taken as one of indexes of the workability, and the relationship between the state of a variation in r value depending upon coiling temperature and K and L values was investigated. The results are shown in FIGS. 1 to 3.

FIG. 1 is a diagram showing an example of the above relationship with respect to an ultra low carbon steel with Nb being added alone. In this case, steel composition listed in Tables 1 and 2 were used, and, for each steel, the K and L values (average value) were plotted as abscissa against, as ordinate, a value obtained by multiplying 100 by a value which has been obtained by dividing the difference between the r value for the highest coiling temperature (r (high CT)) and the r value for the lowest coiling temperature (r (low CT)) by the difference between the highest coiling temperature and the lowest coiling temperature for each steel listed in Table 3. Therefore, a value nearer to zero shows that a substantially constant r value can be obtained substantially independently of the coiling temperature (the dependency upon coiling temperature is small), demonstrating that the r value (workability) is homogenized.

In FIG. 1 (1), when the K value is not more than 0.2, the value on the ordinate is substantially zero. Further, in FIG. 1 (2), when the L value is not less than 0.7, the values on the ordinate gather at substantially zero. That is, when the K value is not more than 0.2 and the L value is not less than 0.7, the precipitation of the carbosulfide is significant in reducing the amount of C in solid solution before coiling to give a constant r value independently of the coiling temperature. Further, in this case, the r value in the front end portion, the center portion, and the rear end portion is also high and constant (see FIG. 5).

Figure 2:
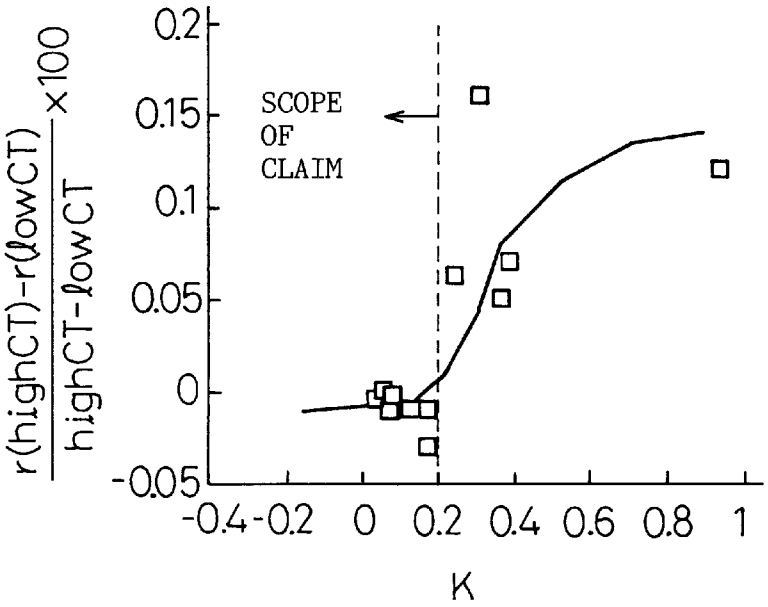
FIG. 2 (1) is a diagram showing the relationship between the dependency of r value upon coiling temperature and K value in the case of the addition of a combination of Ti and Nb.
Figure 2:
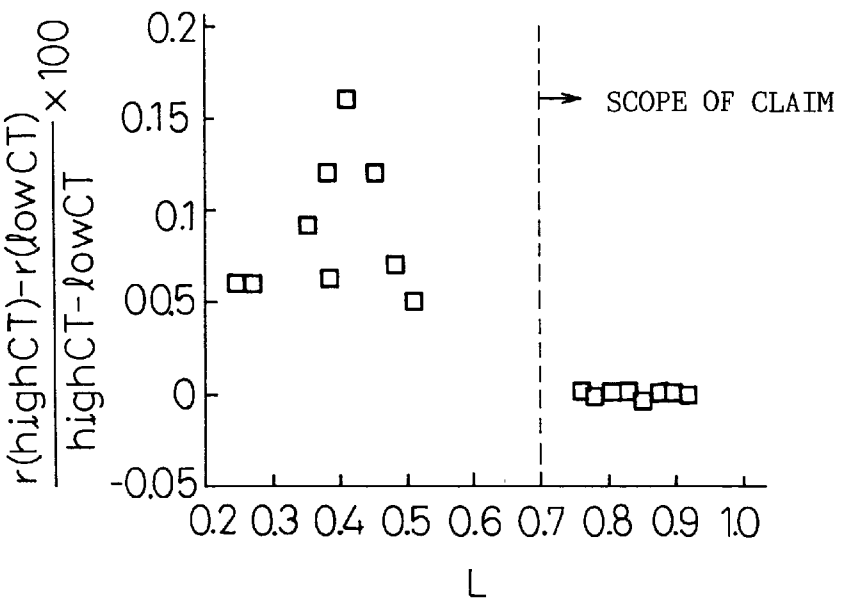
Figure 3:
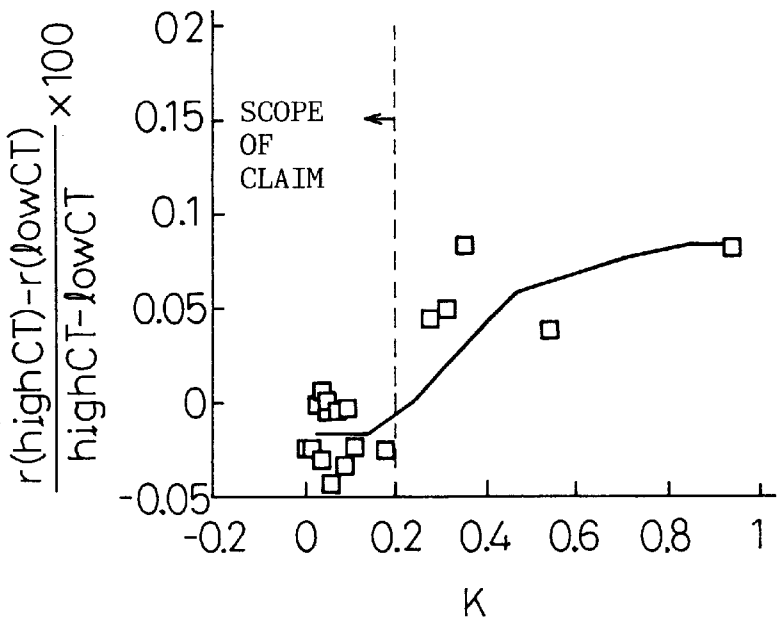
FIG. 3 (1) is a diagram showing the relationship between the dependency of r value upon coiling temperature and K value in the case of the addition of Ti alone.
Figure 3:
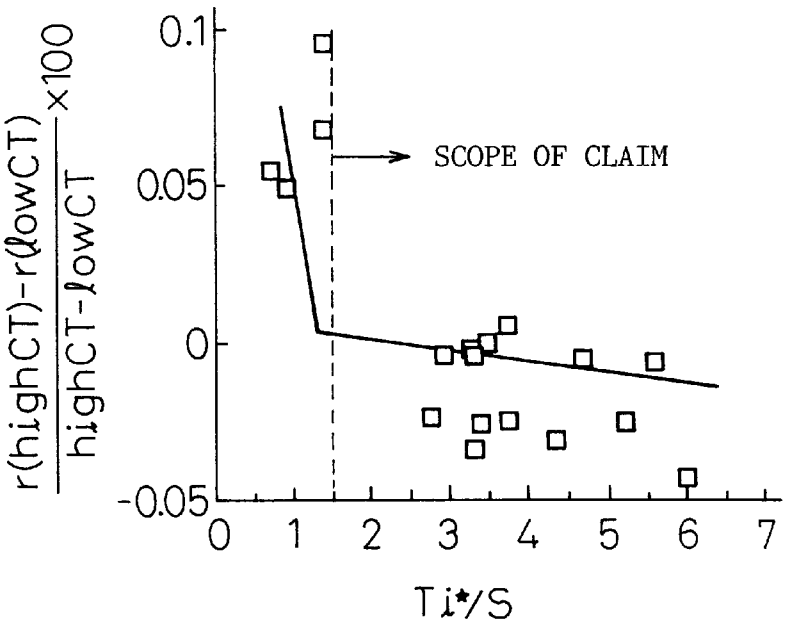

As shown in FIG. 2, the same results are obtained also in the case of the addition of Ti in combination with Nb. FIG. 2 shows the results tabulated in Tables 11 and 12 on an experiment using chemical compositions listed in Tables 9 and 10.

As shown in FIG. 3, the addition of Ti alone provides the same results. In this case, the results show that, when the Ti*/S value is not less than 1.5, a large amount of $Ti_4C_2S_2$ is precipitated before coiling. In this case, as is apparent from Tables 20 to 30, the precipitation of TiC is detected. However, the amount thereof is very small, indicating that $Ti_4C_2S_2$ is precipitated in a large amount and C in solid solution is hardly present. FIG. 3 shows the results tabulated in Tables 20 to 30 on an experiment using chemical compositions listed in Tables 17 to 19.

Figure 4:
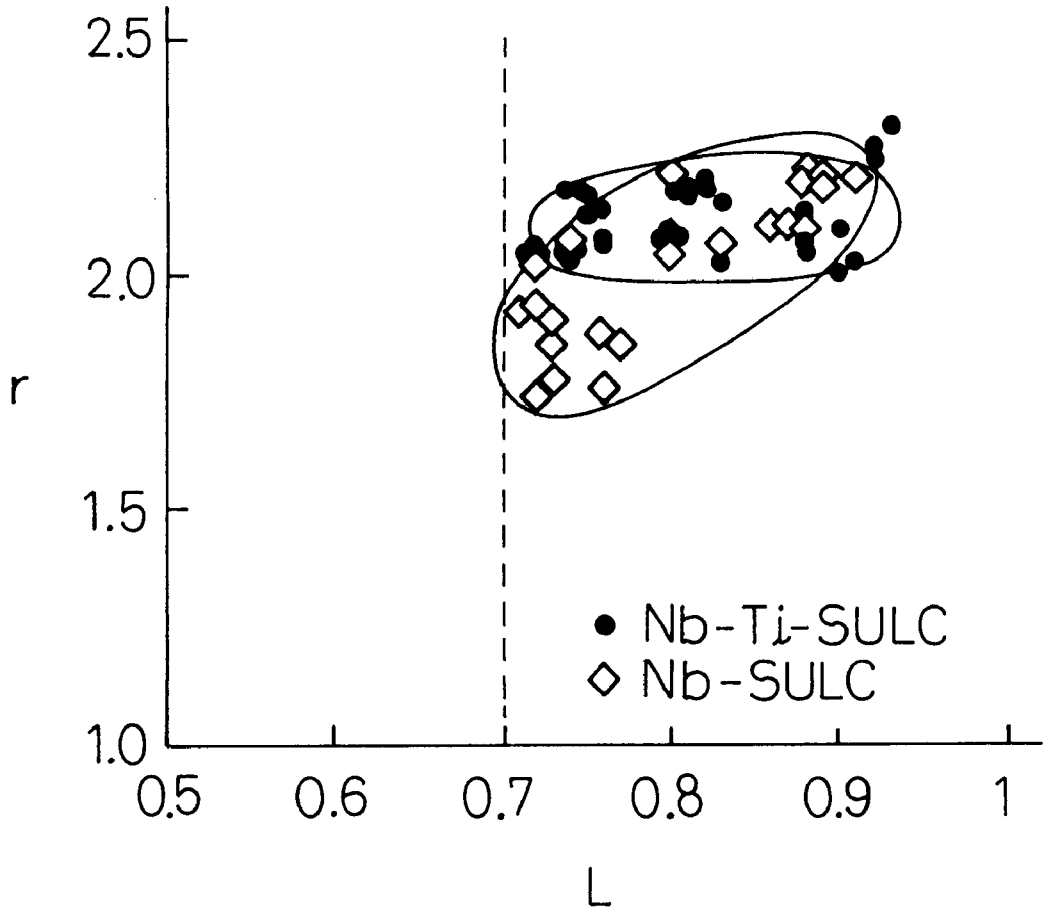
FIG. 4 is a diagram showing the relationship between r and L in the case of the addition of Nb alone and in the case of the addition of a combination of Ti and Nb.

Comparison of the absolute value of the r value in the case of the addition of Nb alone with the absolute value of the r value in the case of the addition of Nb in combination with Ti is shown in FIG. 4. As is apparent from FIG. 4, the addition of Nb in combination with Ti offers higher r value, confirming the effect attained by the addition of a combination of Nb with Ti.

The Nb-containing or Ti-Nb-containing carbosulfide is a compound wherein a part of Ti in $Ti_4C_2S_2$ has been replaced with Nb. For example, it has the following composition ratio in terms of atomic ratio: $1 \leqq Nb/S \leqq 2$ and $1 \leqq Nb/C \leqq 2$ (for example, $Nb_4C_2S_2$), or $1 \leqq Ti/Nb \leqq 9$, $1 \leqq (Ti+Nb)/S \leqq 2$ and $1 \leqq (Ti+Nb)/C \leqq 2$ (for example, $(Ti_9Nb_1)_4C_2S_2$).

Further, the (% C as carbosulfide) is determined as follows.

Specifically, the precipitate is extracted by a method wherein carbides having a small size, TiC and NbC, are dissolved with the aid of sulfuric acid and aqueous hydrogen peroxide or the like. The residue is chemically analyzed to determine the amount of Nb (=N (g)). Since the Nb-containing or Ti-Nb-containing carbosulfide falls within the above composition ratio range, the minimum C content estimated from the amount of the Nb (=N) is regarded as (% C as carbosulfide). Therefore, in the case of the Nb-containing carbosulfide, (% C as carbide)=N/2Z×12/93×100 (%), and, in the case of the Ti-Nb-containing carbosulfide, (% C as carbosulfide)=N/Z×12/93×100 (%), wherein Z is the extraction of the whole sample, g.

In the case of a steel with Ti added alone, by virtue of low Mn and specifying of Ti*/S, $Ti_4C_2S_2$ is satisfactorily precipitated, so that the amount of C in solid solution is reduced to a very low level before coiling. In this case, however, when a very small amount of C in solid solution remaining in the steel is precipitated as a carbide during coiling, the properties of the material are deteriorated. Specifically, when C precipitated as the carbide exceeds 0.0003%, the amount of fine precipitate is increased, inhibiting the growth of grains during annealing and, consequently, resulting in lowered r value. Therefore, if necessary, the amount of C precipitated as the carbide is brought to not more than 0.0003%. For this reason, the amount of C precipitated as a carbide having a diameter of not more than 10 nm is preferably not more than 0.0001%, and the amount of C precipitated as a carbide having a diameter of not more than 20 nm is not more than 0.0002%. The amount of C precipitated as the carbide (=C (%)) is determined by conducting electrolytic extraction in a non-aqueous solvent, chemically analyzing all the resultant precipitates, and subtracting the amount of Ti precipitated as TiN (=T1 (%)) and the amount of Ti precipitated as $Ti_4C_2S_2$ (=T2 (%)) from the amount of Ti determined as Ti compound (=T (%)) to determine the amount of Ti. Thus, C=(T−T1−T2)/4 wherein T1=% total N×3.42 and T2=S×3 wherein S represents the amount of S in the extraction residue.

(% S as MnS) is determined as follows.

Specifically, the precipitate is electrolytically extracted with a solvent which does not dissolve the sulfide (for example, nonaqueous solvent). The resultant extraction residue is chemically analyzed to determine the amount of Mn (=X (g)). When the amount of electrolysis in the whole sample is Y (g), (% S as MnS)=X/Y×32/55×100 (%) .

B functions to strengthen grain boundaries to improve the formability and is added, as a constituent of the steel of the present invention, in an amount of 0.0001 to 0.0030% according to need. When the B content is less than 0.0001%, the effect is unsatisfactory, while when it exceeds 0.0030%, the effect is saturated and, at the same time, the ductility is deteriorated.

Raw materials for providing the above composition are not particularly limited. For example, an iron ore may be provided as the raw material, followed by the preparation of the composition in a blast furnace and a converter. Alternatively, scrap may be used as the raw material. Further, it may be melt-processed in an electric furnace. When scrap is used as the whole or a part of the raw material, it may contain elements such as Cu, Cr, Ni, Sn, Sb, Zn, Pb, and Mo.

Next, the process for producing a cold rolled steel sheet according to the present invention will be described.

There is no particular limitation on the process for producing a slab to be used in the present invention. That is, any slab may be used, and examples thereof include a slab produced from an ingot, a continuously cast slab, and a slab produced by means of a thin slab caster. Immediately after casting of the slab, the slab is hot rolled. It is also possible to use a direct continuous casting-direct rolling (CC-DR) process.

The resultant slab is usually heated. In the case of a steel with a Ni added thereto or a steel with a combination of Nb and Ti added thereto, the heating temperature should be 1250° C. or below in order to increase the amount of precipitated Ti- and Nb-containing carbosulfides as much as possible. When Ti is added alone, the heating temperature should be 1200° C. or below from the viewpoint of increasing the amount of $Ti_4C_2S_2$ precipitated. For the above reason, the heating temperature is preferably 1150° C. or below. The lower limit of the heating temperature is 1000° C. from the viewpoint of ensuring the finishing temperature.

The heated slab is transferred to a hot rolling machine where it is subjected to conventional rolling at a finishing temperature in the range of from ($Ar_3$—100)° C. to 1000° C. For example, regarding the finishing thickness of the rough rolling, a rough bar having a thickness of 20 to 40 mm is rolled with a total reduction in the finish rolling of 60 to 95% to prepare a hot rolled sheet having a minimum thickness of 3 to 6 mm.

After the completion of the finish rolling, the hot rolled sheet is then coiled.

The present invention has a feature that, even when the coiling temperature is low, the workability can be ensured. Specifically, in the present invention, in a period between hot rolling and cooling after hot rolling, C is fully precipitated as a Nb-containing carbosulfide. Therefore, coiling at an elevated temperature does not result in any significantly further improved properties of the material, and coiling at a low temperature does not result in deteriorated properties in the end portions of the coil. Therefore, coiling may be performed at any temperature suitable for the operation, and, when coiling at an elevated temperature is desired, a temperature of 800° C. may be adopted, while when coiling at a low temperature is desired, room temperature may be adopted. That is, the steel sheet of the present invention is not influenced by the coiling temperature. The reason why the upper limit of the coiling temperature is 800° C. is that a coiling temperature exceeding 800° C. coarsens grains of the hot rolled sheet and increases the thickness of oxide scale on the surface of the sheet, resulting in increased pickling cost.

The reason why the lower limit of the coiling temperature is room temperature is that coiling at a temperature below room temperature requires an extra system and, at the same time, offers no particular effect.

In the case of the steel of the present invention, however, when the coiling temperature is high, the precipitation of a very small amount of C in solid solution remaining unfixed or the precipitation of a compound of P occurs, which is likely to deteriorate the properties of the material. For this reason, when an improvement in the properties of the material is contemplated, the coiling is preferably carried out at a temperature of 650° C. or below. In order to completely avoid the precipitation of these harmful compounds, the coiling is performed at a temperature of 500° C. or below. Further, when the time taken for the temperature to be decreased to around room temperature after coiling should be shortened, preferably, the hot rolled steel strip is rapidly cooled and coiled at a temperature of 100° C. or below. It is needless to say that such cooling at a low temperature can reduce the production cost.

The coil is then fed to a cold rolling machine. The reduction ratio of the cold rolling is not less than 60% from the viewpoint of ensuring the deep drawability. The upper limit of the reduction ratio is 98% because a reduction ratio exceeding 98% results only in an increase in load to a cold rolling machine and offers no particular further effect.

The cold rolled steel strip is transferred to a continuous annealing furnace where it is annealed at the recrystallization temperature or above, that is, in the temperature range of from 700 to 900° C., for 30 to 90 sec, in order to ensure the workability.

When the cold rolled steel strip is galvanized, it is passed through a continuous galvanizing line comprising a continuous annealing furnace, a cooling system, and a plating tank. In the galvanizing line, the steel strip is heated in the annealing furnace so that the highest attainable temperature is 750 to 900° C. In the course of cooling, the steel strip is immersed in a galvanizing tank in the temperature range of from 420 to 500° C. to conduct plating. This temperature range has been determined by taking into consideration the plating property and the adhesion of plating.

After the plating, in order to alloy the plating, the plated strip is transferred to a heating furnace where it is alloyed in the temperature range of 400 to 600° C. for 1 to 30 sec. When the alloying temperature is below 400° C., the alloying reaction rate is so low that the productivity is deteriorated and, at the same time, the corrosion resistance and the weldability are very poor. On the other hand, when the alloying temperature exceeds 600° C., the peeling resistance of the plating is deteriorated. Alloying in the temperature range of from 480 to 550° C. is preferred from the viewpoint of providing a plating having better adhesion.

The heating rate in the continuous annealing and the continuous galvanizing line is not particularly limited and may be a conventional one or alternatively may be high, that is, not less than 1000° C./sec.

Besides galvanizing, various other surface treatments, such as electroplating, may be applied.

EXAMPLES

The present invention will be described in more detail with reference to the following examples.

Example 1

Ultra low carbon steels, with Nb added thereto, having chemical compositions specified in Tables 1 and 2 (continuation of Table 1) were tapped from a converter and cast by means of a continuous casting machine into slabs which were then heated to 1140° C. and hot rolled under conditions of finishing temperature 925° C. and sheet thickness 4.0 mm. The average cooling rate on a run out table was about 30° C./sec, and the hot rolled steel strips were then coiled at different temperatures as indicated in Tables 3 and 4 (continuation of Table 3). Samples were taken off from the center portion in the longitudinal direction of the hot rolled coils and treated as follows. Specifically, in a laboratory they were pickled, cold rolled to 0.8 mm, and subjected to heat treatment corresponding to continuous annealing. Annealing conditions were as follows. Annealing temp.: (as indicated in Tables 3 and 4), soaking: 60 sec, cooling rate: 5° C./sec in cooling from the annealing temp. to 680° C., and about 65° C./sec in cooling from 680° C. to room temp. Thereafter, the samples were then temper rolled with a reduction ratio of 0.7% and used for a tensile test. The tensile test and the measurement of average Lankford value (hereinafter referred to as "r value") were carried out using a JIS No. 5 test piece. The r value was evaluated at an elongation of 15% and calculated by the following equation based on values for rolling direction (direction L), direction perpendicular to the rolling direction (direction C), and direction at 45° to the rolling direction (direction D)

$$r=(r_L+2r_D+r_c)/4$$

The test results are summarized in Tables 3 and 4.

TABLE 1

(wt %)

| Steel | C | Si | Mn | P | S | Al | Nb | B | N | K* | Remarks |
|---|---|---|---|---|---|---|---|---|---|---|---|
| A | 0.0023 | 0.01 | 0.09 | 0.006 | 0.010 | 0.04 | 0.029 | — | 0.0018 | 0.11 | Inv. |
| B | 0.0034 | 0.02 | 0.13 | 0.007 | 0.013 | 0.05 | 0.033 | 0.0003 | 0.0021 | 0.05 | Inv. |
| C | 0.0008 | 0.01 | 0.06 | 0.009 | 0.008 | 0.04 | 0.026 | — | 0.0023 | 0.18 | Inv. |
| D | 0.0032 | 0.02 | 0.32 | 0.015 | 0.017 | 0.03 | 0.056 | — | 0.0016 | 0.36 | Comp. |
| E | 0.0019 | 0.02 | 0.25 | 0.006 | 0.014 | 0.05 | 0.001 | 0.0005 | 0.0017 | 0.42 | Comp. |
| F | 0.0025 | 0.01 | 0.11 | 0.008 | 0.013 | 0.05 | 0.042 | 0.0002 | 0.0025 | 0.10 | Inv. |
| G | 0.0013 | 0.01 | 0.05 | 0.009 | 0.012 | 0.04 | 0.025 | — | 0.0023 | 0.03 | Inv. |
| H | 0.0027 | 0.03 | 0.10 | 0.007 | 0.010 | 0.03 | 0.039 | 0.0004 | 0.0020 | 0.12 | Inv. |
| I | 0.0022 | 0.01 | 0.13 | 0.008 | 0.001 | 0.03 | 0.036 | — | 0.0021 | 0.08 | Comp. |
| J | 0.0030 | 0.02 | 0.41 | 0.010 | 0.013 | 0.04 | 0.049 | 0.0003 | 0.0017 | 0.65 | Comp. |

*K = (% S as MnS)/(% total S)

TABLE 2

(Continuation of Table 1)

(wt %)

| Steel | C | Si | Mn | P | S | Al | Nb | B | N | K* | Remarks |
|---|---|---|---|---|---|---|---|---|---|---|---|
| K | 0.0021 | 0.02 | 0.07 | 0.017 | 0.012 | 0.03 | 0.040 | 0.0003 | 0.0019 | 0.04 | Inv. |
| L | 0.0032 | 0.01 | 0.12 | 0.008 | 0.011 | 0.03 | 0.046 | 0.0002 | 0.0014 | 0.08 | Inv. |
| M | 0.0018 | 0.02 | 0.10 | 0.009 | 0.009 | 0.04 | 0.031 | — | 0.0025 | 0.13 | Inv. |
| N | 0.0020 | 0.01 | 0.27 | 0.007 | 0.018 | 0.05 | 0.036 | — | 0.0019 | 0.31 | Comp. |
| O | 0.0025 | 0.01 | 0.10 | 0.006 | 0.002 | 0.03 | 0.042 | 0.0004 | 0.0021 | 0.11 | Comp. |
| P | 0.0024 | 0.01 | 0.08 | 0.052 | 0.012 | 0.04 | 0.041 | — | 0.0023 | 0.07 | Inv. |
| Q | 0.0020 | 0.02 | 0.09 | 0.086 | 0.007 | 0.04 | 0.035 | 0.0003 | 0.0022 | 0.15 | Inv. |
| R | 0.0019 | 0.01 | 0.12 | 0.069 | 0.010 | 0.05 | 0.030 | — | 0.0016 | 0.13 | Inv. |
| S | 0.0030 | 0.02 | 0.07 | 0.076 | 0.002 | 0.03 | 0.042 | — | 0.0020 | 0.09 | Comp. |
| T | 0.0022 | 0.01 | 1.50 | 0.089 | 0.013 | 0.04 | 0.036 | 0.0004 | 0.0019 | 0.80 | Comp. |

*K = (% S as MnS)/(% total S)

TABLE 3

| No. | Steel | Coiling temp., ° C. | Annealing temp., ° C. | L | TS, MPa | El, % | r | Remarks |
|---|---|---|---|---|---|---|---|---|
| 1 | A | 680 | 810 | 0.74 | 295 | 49 | 2.05 | Inv. |
| 2 | | 520 | 810 | 0.72 | 296 | 48 | 2.04 | Inv. |
| 3 | | 400 | 810 | 0.72 | 300 | 47 | 2.02 | Inv. |
| 4 | B | 710 | 740 | 0.76 | 295 | 48 | 1.87 | Inv. |
| 5 | | 560 | 740 | 0.77 | 297 | 47 | 1.85 | Inv. |
| 6 | | 180 | 740 | 0.73 | 298 | 47 | 1.85 | Inv. |
| 7 | C | 700 | 850 | 0.88 | 298 | 53 | 2.22 | Inv. |
| 8 | | 600 | 850 | 0.89 | 300 | 52 | 2.21 | Inv. |
| 9 | | Room temp. | 850 | 0.80 | 305 | 52 | 2.21 | Inv. |
| 10 | D | 690 | 790 | 0.46 | 307 | 47 | 1.86 | Comp. |
| 11 | | 510 | 790 | 0.42 | 306 | 43 | 1.53 | Comp. |
| 12 | | 410 | 790 | 0.44 | 305 | 42 | 1.31 | Comp. |
| 13 | E | 680 | 820 | 0.39 | 300 | 47 | 1.92 | Comp. |
| 14 | | 590 | 820 | 0.42 | 297 | 42 | 1.39 | Comp. |
| 15 | | 320 | 820 | 0.38 | 300 | 40 | 1.18 | Comp. |
| 16 | F | 720 | 790 | 0.83 | 287 | 50 | 2.06 | Inv. |
| 17 | | 580 | 790 | 0.80 | 298 | 49 | 2.07 | Inv. |
| 18 | | 180 | 790 | 0.80 | 286 | 50 | 2.08 | Inv. |
| 19 | G | 760 | 820 | 0.87 | 302 | 51 | 2.10 | Inv. |
| 20 | | 590 | 820 | 0.88 | 299 | 51 | 2.09 | Inv. |
| 21 | | 50 | 820 | 0.86 | 305 | 50 | 2.10 | Inv. |
| 22 | H | 660 | 780 | 0.71 | 298 | 49 | 1.92 | Inv. |
| 23 | | 530 | 780 | 0.72 | 297 | 48 | 1.93 | Inv. |
| 24 | | 280 | 780 | 0.73 | 299 | 49 | 1.90 | Inv. |
| 25 | I | 730 | 800 | 0.32 | 295 | 45 | 1.72 | Comp. |
| 26 | | 620 | 800 | 0.28 | 298 | 43 | 1.54 | Comp. |
| 27 | | Room temp. | 800 | 0.26 | 302 | 41 | 1.38 | Comp. |
| 28 | J | 700 | 800 | 0.52 | 310 | 48 | 1.78 | Comp. |
| 29 | | 590 | 800 | 0.53 | 310 | 43 | 1.46 | Comp. |
| 30 | | 410 | 800 | 0.5O | 312 | 42 | 1.25 | Comp. |

TABLE 4

(Continuation of Table 3)

| No. | Steel | Coiling temp., ° C. | Annealing temp., ° C. | L | TS, MPa | El, % | r | Remarks |
|---|---|---|---|---|---|---|---|---|
| 31 | K | 690 | 830 | 0.91 | 305 | 52 | 2.20 | Inv. |
| 32 | | 510 | 830 | 0.88 | 307 | 53 | 2.19 | Inv. |
| 33 | | 370 | 830 | 0.89 | 309 | 51 | 2.18 | Inv. |
| 34 | L | 700 | 765 | 0.72 | 297 | 44 | 1.75 | Inv. |
| 35 | | 540 | 765 | 0.76 | 298 | 43 | 1.76 | Inv. |
| 36 | | Room temp. | 765 | 0.73 | 299 | 44 | 1.77 | Inv. |
| 37 | M | 740 | 800 | 0.74 | 296 | 50 | 2.07 | Inv. |
| 38 | | 550 | 800 | 0.80 | 299 | 50 | 2.04 | Inv. |
| 39 | | 180 | 800 | 0.75 | 304 | 49 | 2.06 | Inv. |
| 40 | N | 700 | 845 | 0.54 | 295 | 49 | 1.93 | Comp. |
| 41 | | 530 | 845 | 0.54 | 298 | 46 | 1.76 | Comp. |
| 42 | | 290 | 845 | 0.57 | 301 | 41 | 1.54 | Comp. |
| 43 | O | 710 | 750 | 0.49 | 294 | 45 | 1.76 | Comp. |
| 44 | | 610 | 750 | 0.52 | 296 | 43 | 1.56 | Comp. |
| 45 | | 100 | 750 | 0.50 | 298 | 42 | 1.49 | Comp. |
| 46 | P | 690 | 810 | 0.86 | 344 | 45 | 1.92 | Inv. |
| 47 | | 530 | 810 | 0.84 | 342 | 46 | 1.91 | Inv. |
| 48 | | 310 | 810 | 0.85 | 340 | 45 | 1.92 | Inv. |
| 49 | Q | 670 | 790 | 0.83 | 370 | 43 | 1.89 | Inv. |
| 50 | | 550 | 790 | 0.85 | 376 | 42 | 1.90 | Inv. |
| 51 | | 280 | 790 | 0.84 | 379 | 43 | 1.90 | Inv. |
| 52 | R | 690 | 780 | 0.79 | 361 | 41 | 1.87 | Inv. |
| 53 | | 580 | 780 | 0.76 | 361 | 42 | 1.89 | Inv. |
| 54 | | 160 | 780 | 0.78 | 364 | 42 | 1.88 | Inv. |
| 55 | S | 710 | 800 | 0.42 | 370 | 42 | 1.72 | Comp. |
| 56 | | 620 | 800 | 0.44 | 366 | 40 | 1.58 | Comp. |
| 57 | | 300 | 800 | 0.45 | 372 | 37 | 1.23 | Comp. |
| 58 | T | 720 | 780 | 0.38 | 385 | 38 | 1.65 | Comp. |
| 59 | | 580 | 780 | 0.34 | 385 | 36 | 1.23 | Comp. |
| 60 | | 240 | 780 | 0.35 | 384 | 33 | 1.08 | Comp. |

As is apparent from Tables 3 and 4, for steels having compositions falling within the scope of the present invention, coiling at a temperature of 800° C. or below offers good properties. In particular, for steels C, G, and K, wherein the Mn content was low, the amount of Nb added was sufficient for C and the annealing temperature was high, the coiling temperature could be lowered to reduce the amount of C precipitated as fine carbide, offering very good properties. On the other hand, for the comparative steels, it is evident that coiling at low temperatures results in very poor properties.

Example 2

Hot rolled sheets were taken off from the front end (inside periphery of the coil) portion (a position at a distance of 10 m from the extreme front end), the center portion, and the rear end (outer periphery of the coil) portion (a position at a distance of 10 m from the extreme rear end) in the longitudinal direction of hot rolled coils of steels B, C, D, G, H, J, L, N, R, and T, listed in Tables 1 and 2, produced under the same conditions as used in Example 1. The total length of the hot rolled coil was about 240 m. Thereafter, the samples were cold rolled, annealed, and temper rolled under the same conditions as used in Example 1 to prepare cold rolled steel sheets (hot rolled to a thickness of 4 mm followed by cold rolling to a thickness of 0.8 mm) which were then used to investigate the properties in the longitudinal direction of the cold rolled coils.

The test results are summarized in Tables 5 and 6 (continuation of Table 5).

TABLE 5

| | | | | Properties | | | | | | | | | |
|---|---|---|---|---|---|---|---|---|---|---|---|---|---|
| | | Coiling | | 10 m from front end | | | Center | | | 10 m from rear end | | | |
| No. | Steel | temp., ° C. | L | TS, MPa | El, % | r | TS, MPa | El, % | r | TS, MPa | El, % | r | Remarks |
| 61 | B | 710 | 0.76 | 296 | 45 | 1.84 | 295 | 47 | 1.87 | 297 | 46 | 1.86 | Inv. |
| 62 | | 180 | 0.73 | 298 | 47 | 1.86 | 298 | 47 | 1.85 | 296 | 47 | 1.86 | Inv. |
| 63 | C | 700 | 0.88 | 297 | 53 | 2.21 | 298 | 53 | 2.22 | 299 | 52 | 2.23 | Inv. |
| 64 | | Room temp. | 0.80 | 304 | 53 | 2.20 | 305 | 52 | 2.21 | 302 | 52 | 2.21 | Inv. |
| 65 | D | 690 | 0.46 | 306 | 44 | 1.67 | 307 | 47 | 1.86 | 304 | 44 | 1.66 | Comp. |
| 66 | | 410 | 0.44 | 305 | 41 | 1.31 | 305 | 42 | 1.31 | 308 | 40 | 1.29 | Comp. |
| 67 | G | 760 | 0.87 | 301 | 52 | 2.11 | 302 | 51 | 2.10 | 300 | 50 | 2.12 | Inv. |
| 68 | | 50 | 0.86 | 306 | 50 | 2.10 | 305 | 50 | 2.10 | 306 | 50 | 2.10 | Inv. |
| 69 | H | 660 | 0.71 | 300 | 47 | 1.90 | 298 | 48 | 1.92 | 296 | 47 | 1.89 | Inv. |
| 70 | | 280 | 0.73 | 301 | 47 | 1.89 | 299 | 48 | 1.90 | 304 | 46 | 1.87 | Inv. |

TABLE 6

(Continuation of Table 5)

| | | Coiling | | Properties | | | | | | | | | |
|---|---|---|---|---|---|---|---|---|---|---|---|---|---|
| | | | | 10 m from front end | | | Center | | | 10 m from rear end | | | |
| No. | Steel | temp., ° C. | L | TS, MPa | El, % | r | TS, MPa | El, % | r | TS, MPa | El, % | r | Remarks |
| 71 | J | 700 | 0.52 | 308 | 43 | 1.54 | 310 | 48 | 1.78 | 301 | 42 | 1.61 | Comp. |
| 72 | | 410 | 0.50 | 309 | 42 | 1.20 | 312 | 42 | 1.25 | 304 | 41 | 1.22 | Comp. |
| 73 | L | 700 | 0.72 | 298 | 44 | 1.76 | 297 | 44 | 1.75 | 301 | 44 | 1.75 | Inv. |
| 74 | | Room temp. | 0.73 | 299 | 42 | 1.74 | 299 | 44 | 1.77 | 298 | 43 | 1.75 | Inv. |
| 75 | N | 700 | 0.54 | 297 | 47 | 1.67 | 295 | 50 | 1.93 | 296 | 46 | 1.60 | Comp. |
| 76 | | 290 | 0.57 | 298 | 43 | 1.49 | 301 | 44 | 1.54 | 300 | 42 | 1.25 | Comp. |
| 77 | R | 690 | 0.79 | 359 | 41 | 1.85 | 361 | 41 | 1.87 | 358 | 41 | 1.84 | Inv. |
| 78 | | 160 | 0.78 | 358 | 42 | 1.84 | 364 | 42 | 1.88 | 361 | 43 | 1.86 | Inv. |
| 79 | T | 720 | 0.38 | 386 | 34 | 1.49 | 385 | 38 | 1.65 | 382 | 33 | 1.50 | Comp. |
| 80 | | 240 | 0.35 | 386 | 31 | 1.06 | 384 | 33 | 1.08 | 378 | 30 | 1.03 | Comp. |

As is apparent from Tables 5 and 6, the steels prepared according to the process of the present invention had excellent properties in the center portion of the coil, as well as in the portion at a distance of 10 m from the end. By contrast, for the comparative steels, the properties were remarkably deteriorated in the end portion of the coil, and, in the case of coiling at low temperatures, the properties were very poor over the whole length of the coil. Evidently, this tendency is more significant in positions nearer to the end portion.

Example 3

The influence of the heating temperature in hot rolling on the properties of the materials after cold rolling and annealing was investigated using steels C and Q (slabs tapped from an actual equipment) listed in Tables 1 and 2. The slabs were heated to 1100 to 1350° C. by means of an actual equipment and hot rolled under conditions of finishing temperature 940° C. and sheet thickness 4.0 mm. The average cooling rate on a run out table was about 40° C./sec, and the hot rolled steel strips were then coiled at 620° C. The whole length of the coil was about 200 m. Samples were taken off from the same positions as described above in connection with Example 2, pickled, cold rolled to 0.8 mm, and subjected to heat treatment corresponding to continuous annealing in a laboratory. Annealing conditions were as follows. Annealing temp.: 810° C., soaking: 50 sec, cooling rate: 60° C./sec in cooling to room temp. Thereafter, the samples were temper rolled with a reduction ratio of 0.8% and used for a tensile test.

The test results are summarized in Table 7.

TABLE 7

| | | Heating | 10 in from front end | | | Center | | | 10 in from rear end | | | |
|---|---|---|---|---|---|---|---|---|---|---|---|---|
| No. | Steel | temp., ° C. | TS, MPa | El, % | r | TS, MPa | El, % | r | TS, MPa | El, % | r | Remarks |
| 81 | C | 1100 | 299 | 55 | 2.23 | 297 | 54 | 2.23 | 298 | 55 | 2.24 | Inv. |
| 82 | | 1150 | 306 | 54 | 2.24 | 296 | 54 | 2.22 | 308 | 54 | 2.22 | Inv. |
| 83 | | 1200 | 301 | 54 | 2.21 | 301 | 54 | 2.20 | 303 | 54 | 2.20 | Inv. |
| 84 | | 1250 | 306 | 52 | 2.14 | 304 | 53 | 2.18 | 305 | 53 | 2.13 | Inv. |
| 85 | | 1300 | 303 | 50 | 1.86 | 303 | 50 | 2.06 | 302 | 49 | 1.81 | Comp. |
| 86 | | 1350 | 303 | 47 | 1.59 | 304 | 46 | 1.82 | 304 | 45 | 1.57 | Comp. |
| 87 | Q | 1100 | 378 | 45 | 1.93 | 377 | 44 | 1.93 | 379 | 45 | 1.93 | Inv. |
| 88 | | 1150 | 378 | 43 | 1.92 | 376 | 43 | 1.92 | 378 | 44 | 1.93 | inv. |
| 89 | | 1200 | 375 | 43 | 1.88 | 376 | 43 | 1.90 | 377 | 42 | 1.88 | Inv. |
| 90 | | 1250 | 379 | 42 | 1.87 | 378 | 42 | 1.86 | 378 | 43 | 1.86 | Inv. |
| 91 | | 1300 | 382 | 40 | 1.70 | 380 | 41 | 1.72 | 382 | 40 | 1.65 | Comp. |
| 92 | | 1350 | 380 | 38 | 1.45 | 381 | 38 | 1.64 | 381 | 39 | 1.45 | Comp. |

As is apparent from Table 7, the steels prepared according to the process of the present invention had excellent properties after cold rolling and annealing in the center portion of the coil, as well as in the end portions. By contrast, when the heating temperature was above 1250° C., the properties after cold rolling and annealing were remarkably deteriorated.

Example 4

Steels B, D, G, J, L, N, R, and T listed in Tables 1 and 2 were hot rolled in the same manner as in Example 1 (coiling temperature: 730° C.), subsequently pickled using an actual equipment, cold rolled with a reduction ratio of 80%, and passed through a continuous galvanizing line of in-line annealing system. In this case, the cold rolled strips were heated at the maximum heating temperature 800° C., cooled, subjected to conventional galvanizing (Al concentration of plating bath: 0.12%) at 470° C., and further alloyed by heating at 560° C. for about 12 sec. Thereafter, they were temper rolled with a reduction ratio of 0.8% and evaluated for mechanical properties and adhesion of plating.

The results are summarized in Table 8.

Regarding the adhesion of plating, a sample was bent at 180° C. to close contact, and the peeling of the zinc coating was judged by adhering a pressure-sensitive tape to the bent portion and then peeling the tape, and determining the amount of the peeled plating adhered to the tape. The adhesion of plating was evaluated based on the following five grades.

1: large peeling, 2: medium peeling, 3: small peeling, 4: very small peeling, and 5: no peeling.

TABLE 8

| | | 10 m from front end | | | | Center | | | | 10 m from rear end | | | | |
|---|---|---|---|---|---|---|---|---|---|---|---|---|---|---|
| No. | Steel | TS, MPa | El, % | r | Adhesion of plating | TS, MPa | El, % | r | Adhesion of plating | TS, MPa | El, % | r | Adhesion of plating | Remarks |
| 93 | B | 298 | 48 | 1.79 | 5 | 296 | 47 | 1.77 | 5 | 297 | 47 | 1.78 | 5 | Inv. |
| 94 | D | 305 | 45 | 1.65 | 5 | 306 | 48 | 1.84 | 5 | 302 | 45 | 1.63 | 5 | Comp. |
| 95 | G | 303 | 51 | 2.07 | 4 | 304 | 50 | 2.06 | 5 | 300 | 50 | 2.09 | 5 | Inv. |
| 96 | J | 306 | 42 | 1.56 | 5 | 308 | 47 | 1.75 | 5 | 305 | 42 | 1.58 | 4 | Comp. |
| 97 | L | 299 | 43 | 1.72 | 5 | 299 | 44 | 1.69 | 5 | 302 | 45 | 1.70 | 5 | Inv. |
| 98 | N | 300 | 43 | 1.61 | 5 | 297 | 49 | 1.87 | 5 | 298 | 42 | 1.57 | 5 | Comp. |
| 99 | R | 358 | 41 | 1.82 | 5 | 358 | 42 | 1.86 | 4 | 356 | 40 | 1.81 | 5 | Inv. |
| 100 | T | 382 | 34 | 1.46 | 5 | 382 | 38 | 1.64 | 5 | 385 | 33 | 1.47 | 4 | Comp. |

As is apparent from Table 8, the alloyed, galvanized steel sheets according to the process of the present invention had excellent properties independently of the sites on the coils. By contrast, for the comparative steels, a variation in workability was observed from site to site.

Example 5

Ultra low carbon steels, with Ti and Nb added thereto, having chemical compositions specified in Tables 9 and 10 (continuation of Table 9) were tapped from a converter and cast by means of a continuous casting machine into slabs which were then heated to 1200° C. and hot rolled under conditions of finishing temperature 920° C. and sheet thickness 4.0 mm. The average cooling rate on a run out table was about 40° C./sec, and the hot rolled steel strips were then coiled at different temperatures as indicated in Tables 3 and 4 (continuation of Table 2).

Samples were taken off from the center portion in the longitudinal direction of the hot rolled coils and treated as follows. Specifically, they were pickled, cold rolled to 0.8 mm, and subjected to heat treatment corresponding to continuous annealing in a laboratory. Annealing conditions were as follows. Annealing temp.: 810° C., soaking: 50 sec, cooling rate: about 4° C./sec in cooling from the annealing temp. to 680° C., and about 70° C./sec in cooling from 670° C. to room temp. Thereafter, the samples were then temper rolled with a reduction ratio of 0.8% and used for a tensile test. The tensile test and the measurement of average Lankford value (hereinafter referred to as "r value") were carried out using a JIS No. 5 test piece. The r value was evaluated at an elongation of 15% and calculated by the following equation based on values for rolling direction (direction L), direction perpendicular to the rolling direction (direction C), and direction at 45° to the rolling direction (direction D).

$$r=(r_L+2r_D+r_c)/4$$

The test results are summarized in Tables 11 and 12.

TABLE 9

(wt %)

| Steel | C | Si | Mn | P | S | Al | Ti | Nb | B | N | Ti* | K | Remarks |
|---|---|---|---|---|---|---|---|---|---|---|---|---|---|
| A | 0.0008 | 0.01 | 0.08 | 0.008 | 0.010 | 0.04 | 0.015 | 0.012 | — | 0.0018 | 0.0088 | 0.06 | Inv. |
| B | 0.0023 | 0.02 | 0.06 | 0.009 | 0.009 | 0.04 | 0.021 | 0.023 | — | 0.0015 | 0.0159 | 0.08 | Inv. |
| C | 0.0041 | 0.01 | 0.13 | 0.011 | 0.017 | 0.05 | 0.032 | 0.013 | 0.0003 | 0.0022 | 0.0245 | 0.13 | Inv. |
| D | 0.0020 | 0.02 | 0.21 | 0.008 | 0.015 | 0.04 | 0.043 | 0.012 | — | 0.0026 | 0.0341 | 0.32 | Comp. |
| E | 0.0018 | 0.02 | 0.13 | 0.010 | 0.002 | 0.03 | 0.036 | 0.023 | 0.0005 | 0.0019 | 0.0295 | 0.08 | Comp. |
| F | 0.0025 | 0.01 | 0.05 | 0.007 | 0.012 | 0.04 | 0.018 | 0.021 | — | 0.0025 | 0.0095 | 0.13 | Inv. |
| G | 0.0017 | 0.01 | 0.14 | 0.006 | 0.008 | 0.05 | 0.023 | 0.019 | 0.0004 | 0.0016 | 0.0175 | 0.18 | Inv. |
| H | 0.0024 | 0.01 | 0.10 | 0.007 | 0.010 | 0.05 | 0.013 | 0.009 | — | 0.0022 | 0.0055 | 0.12 | Inv. |
| I | 0.0029 | 0.02 | 0.31 | 0.009 | 0.010 | 0.04 | 0.022 | 0.021 | — | 0.0020 | 0.0152 | 0.95 | Comp. |
| J | 0.0018 | 0.03 | 0.11 | 0.010 | 0.001 | 0.03 | 0.008 | 0.021 | 0.0002 | 0.0016 | 0.0025 | 0.13 | Comp. |

Ti* = Ti—3.42N

K = (% S as MnS)/(% total S)

Underlined value is outside the scope of the present invention.

TABLE 10

(Continuation of Table 9)

(wt %)

| Steel | C | Si | Mn | P | S | Al | Ti | Nb | B | N | Ti* | K | Remarks |
|---|---|---|---|---|---|---|---|---|---|---|---|---|---|
| K | 0.0028 | 0.01 | 0.09 | 0.008 | 0.014 | 0.04 | 0.019 | 0.031 | 0.0005 | 0.0016 | 0.0135 | 0.18 | Inv. |
| L | 0.0032 | 0.02 | 0.07 | 0.011 | 0.018 | 0.05 | 0.015 | 0.034 | 0.0003 | 0.0015 | 0.0099 | 0.08 | Inv. |
| M | 0.0021 | 0.01 | 0.56 | 0.006 | 0.008 | 0.05 | 0.023 | 0.001 | — | 0.0023 | 0.0151 | 0.37 | Comp. |
| N | 0.0036 | 0.01 | 0.29 | 0.007 | 0.009 | 0.04 | 0.014 | 0.041 | — | 0.0021 | 0.0068 | 0.40 | Comp. |
| O | 0.0025 | 0.02 | 0.07 | 0.008 | 0.029 | 0.03 | 0.024 | 0.018 | 0.0004 | 0.0019 | 0.0175 | 0.12 | Comp. |
| P | 0.0037 | 0.01 | 0.09 | 0.056 | 0.014 | 0.05 | 0.016 | 0.021 | 0.0003 | 0.0018 | 0.0098 | 0.08 | Inv. |
| Q | 0.0029 | 0.0i | 0.11 | 0.093 | 0.012 | 0.04 | 0.060 | 0.011 | — | 0.0023 | 0.0521 | 0.04 | Inv. |
| R | 0.0018 | 0.03 | 0.12 | 0.072 | 0.007 | 0.05 | 0.011 | 0.012 | — | 0.0014 | 0.0062 | 0.09 | Inv. |
| S | 0.0023 | 0.02 | 1.30 | 0.056 | 0.010 | 0.03 | 0.025 | 0.019 | — | 0.0025 | 0.0165 | 0.25 | Comp. |
| T | 0.0018 | 0.01 | 0.06 | 0.089 | 0.002 | 0.04 | 0.039 | 0.023 | 0.0004 | 0.0018 | 0.0328 | 0.08 | Comp. |

Ti* = Ti—3.42N
K = (% S as MnS)/(% total S)
Underlined value is outside the scope of the present invention.

TABLE 11

| No. | Steel | Coiling temp., ° C. | L, % | TS, MPa | El, % | r | Remarks |
|---|---|---|---|---|---|---|---|
| 1 | A | 760 | 0.81 | 297 | 50 | 2.18 | Inv. |
| 2 | | 620 | 0.80 | 296 | 53 | 2.18 | Inv. |
| 3 | | 180 | 0.82 | 300 | 52 | 2.20 | Inv. |
| 4 | B | 670 | 0.83 | 301 | 53 | 2.15 | Inv. |
| 5 | | 550 | 0.81 | 299 | 52 | 2.16 | Inv. |
| 6 | | 360 | 0.82 | 299 | 52 | 2.18 | Inv. |
| 7 | C | 720 | 0.76 | 323 | 51 | 2.07 | Inv. |
| 8 | | 410 | 0.75 | 323 | 50 | 2.12 | Inv. |
| 9 | | Room temp. | 0.76 | 325 | 51 | 2.13 | Inv. |
| 10 | D | 750 | 0.42 | 307 | 48 | 1.86 | Comp. |
| 11 | | 610 | 0.45 | 306 | 47 | 1.53 | Comp. |
| 12 | | 410 | 0.43 | 305 | 46 | 1.32 | Comp. |
| 13 | E | 670 | 0.39 | 330 | 49 | 1.87 | Comp. |
| 14 | | 510 | 0.38 | 330 | 44 | 1.41 | Comp. |
| 15 | | 100 | 0.42 | 330 | 42 | 1.21 | Comp. |
| 16 | F | 730 | 0.92 | 287 | 51 | 2.24 | Inv. |
| 17 | | 570 | 0.92 | 285 | 54 | 2.27 | Inv. |
| 18 | | 80 | 0.93 | 286 | 53 | 2.31 | Inv. |
| 19 | G | 660 | 0.76 | 282 | 54 | 2.15 | Inv. |
| 20 | | 530 | 0.75 | 282 | 53 | 2.17 | Inv. |
| 21 | | 60 | 0.74 | 283 | 54 | 2.18 | Inv. |
| 22 | H | 660 | 0.83 | 298 | 52 | 2.02 | Inv. |
| 23 | | 520 | 0.76 | 299 | 53 | 2.06 | Inv. |
| 24 | | Room temp. | 0.80 | 296 | 53 | 2.09 | Inv. |
| 25 | I | 710 | 0.46 | 304 | 50 | 1.72 | Comp. |
| 26 | | 650 | 0.45 | 302 | 47 | 1.54 | Comp. |
| 27 | | 450 | 0.46 | 303 | 46 | 1.42 | Comp. |
| 28 | J | 700 | 0.25 | 311 | 48 | 1.51 | Comp. |
| 29 | | 620 | 0.28 | 308 | 46 | 1.20 | Comp. |
| 30 | | 140 | 0.26 | 306 | 45 | 1.15 | Comp. |

TABLE 12

(Continuation of Table 11)

| No. | Steel | Coiling temp., ° C. | L, % | TS, MPa | El, % | r | Remarks |
|---|---|---|---|---|---|---|---|
| 31 | K | 680 | 0.88 | 296 | 51 | 2.04 | Inv. |
| 32 | | 580 | 0.90 | 298 | 53 | 2.09 | Inv. |
| 33 | | 360 | 0.88 | 298 | 53 | 2.13 | Inv. |
| 34 | L | 760 | 0.90 | 306 | 50 | 2.00 | Inv. |
| 35 | | 630 | 0.91 | 304 | 52 | 2.03 | Inv. |
| 36 | | 180 | 0.88 | 302 | 53 | 2.07 | Inv. |
| 37 | M | 680 | 0.52 | 290 | 48 | 1.51 | Comp. |
| 38 | | 510 | 0.48 | 291 | 46 | 1.34 | Comp. |
| 39 | | Room temp. | 0.51 | 290 | 45 | 1.21 | Comp. |
| 40 | N | 690 | 0.49 | 292 | 46 | 1.82 | Comp. |
| 41 | | 600 | 0.46 | 293 | 44 | 1.49 | Comp. |

TABLE 12-continued (Continuation of Table 11)

| No. | Steel | Coiling temp., ° C. | L, % | TS, MPa | El, % | r | Remarks |
|---|---|---|---|---|---|---|---|
| 42 | | 50 | 0.45 | 292 | 43 | 1.39 | Comp. |
| 43 | O | 760 | 0.28 | 296 | 48 | 1.84 | Comp. |
| 44 | | 500 | 0.19 | 295 | 47 | 1.56 | Comp. |
| 45 | | 130 | 0.26 | 295 | 46 | 1.49 | Comp. |
| 46 | P | 680 | 0.92 | 353 | 46 | 1.91 | Inv. |
| 47 | | 550 | 0.86 | 352 | 47 | 1.92 | Inv. |
| 48 | | 200 | 0.88 | 350 | 46 | 1.92 | Inv. |
| 49 | Q | 720 | 0.85 | 408 | 38 | 1.83 | Inv. |
| 50 | | 560 | 0.87 | 407 | 40 | 1.85 | Inv. |
| 51 | | 320 | 0.85 | 403 | 42 | 1.85 | Inv. |
| 52 | R | 690 | 0.78 | 361 | 45 | 1.89 | Inv. |
| 53 | | 530 | 0.81 | 355 | 45 | 1.89 | Inv. |
| 54 | | 150 | 0.82 | 353 | 45 | 1.90 | Inv. |
| 55 | S | 680 | 0.39 | 344 | 45 | 1.67 | Comp. |
| 56 | | 590 | 0.43 | 341 | 43 | 1.40 | Comp. |
| 57 | | Room temp. | 0.46 | 342 | 40 | 1.26 | Comp. |
| 58 | T | 670 | 0.36 | 384 | 39 | 1.65 | Comp. |
| 59 | | 560 | 0.38 | 382 | 37 | 1.25 | Comp. |
| 60 | | 100 | 0.34 | 381 | 34 | 1.13 | Comp. |

As is apparent from Tables 11 and 12, for steels having composition falling within the scope of the present invention, coiling at a temperature of 800° C. or below offers good properties. In particular, for steels A, B, F, and K, wherein the Mn content was low and the amount of Nb and Ti added was sufficient for C, the coiling temperature could be lowered to reduce the amount of C precipitated as fine carbide, offering very good properties. On the other hand, for the comparative steels, it is evident that coiling at low temperatures results in very poor properties.

Example 6

Hot rolled sheets were taken off from the front end (inside periphery of the coil) portion (a position at a distance of 10 m from the extreme front end), the center portion, and the rear end (outer periphery of the coil) portion (a position at a distance of 10 m from the extreme rear end) in the longitudinal direction of hot rolled coils of steels A, B, D, F, I, L, M, N, R, and S, listed in Tables 9 and 10, produced under the same conditions as used in Example 5. The total length of the hot rolled coil was about 240 m. Thereafter, the samples were cold rolled, annealed, and temper rolled under the same conditions as used in Example 5 to prepare cold rolled steel sheets (hot rolled to a thickness of 4 mm followed by cold rolling to a thickness of 0.8 mm) which were then used to investigate the properties in the longitudinal direction of the cold rolled coils.

The test results are summarized in Table 13.

TABLE 13

| | | Coiling | | Properties | | | | | | | | | |
|---|---|---|---|---|---|---|---|---|---|---|---|---|---|
| | | | | 10 m from front end | | | Center | | | 10 m from rear end | | | |
| No. | Steel | temp., ° C. | L | TS, MPa | El, % | r | TS, MPa | El, % | r | TS, MPa | El, % | r | Remarks |
| 61 | A | 620 | 0.80 | 297 | 51 | 2.20 | 297 | 50 | 2.18 | 296 | 51 | 2.19 | Inv. |
| 62 | | 180 | 0.82 | 305 | 51 | 2.19 | 300 | 52 | 2.20 | 300 | 52 | 2.20 | Inv. |
| 63 | B | 670 | 0.83 | 308 | 53 | 2.16 | 301 | 53 | 2.15 | 310 | 53 | 2.16 | Inv. |
| 64 | | 360 | 0.82 | 301 | 54 | 2.19 | 299 | 52 | 2.18 | 305 | 53 | 2.18 | Inv. |
| 65 | D | 750 | 0.42 | 306 | 45 | 1.49 | 307 | 48 | 1.86 | 306 | 46 | 1.54 | Comp. |
| 66 | | 410 | 0.43 | 305 | 43 | 1.31 | 305 | 46 | 1.32 | 304 | 42 | 1.26 | Comp. |
| 67 | F | 730 | 0.92 | 285 | 53 | 2.27 | 287 | 51 | 2.24 | 286 | 52 | 2.28 | Inv. |
| 68 | | 80 | 0.93 | 286 | 54 | 2.31 | 286 | 53 | 2.31 | 286 | 53 | 2.32 | Inv. |
| 69 | I | 710 | 0.46 | 302 | 49 | 1.62 | 304 | 50 | 1.72 | 304 | 48 | 1.59 | Comp. |
| 70 | | 450 | 0.46 | 301 | 44 | 1.42 | 303 | 46 | 1.42 | 300 | 45 | 1.41 | Comp. |
| 71 | L | 760 | 0.90 | 306 | 51 | 2.02 | 306 | 50 | 2.00 | 306 | 51 | 2.04 | Inv. |
| 72 | | 180 | 0.88 | 301 | 55 | 2.10 | 302 | 53 | 2.07 | 303 | 53 | 2.08 | Inv. |
| 73 | M | 680 | 0.52 | 290 | 49 | 1.49 | 290 | 48 | 1.51 | 286 | 48 | 1.46 | Comp. |
| 74 | | Room temp. | 0.51 | 290 | 45 | 1.26 | 290 | 45 | 1.21 | 293 | 46 | 1.23 | Comp. |
| 75 | N | 690 | 0.49 | 290 | 46 | 1.57 | 292 | 46 | 1.82 | 292 | 44 | 1.62 | Comp. |
| 76 | | 50 | 0.45 | 292 | 45 | 1.40 | 292 | 43 | 1.39 | 295 | 45 | 1.36 | Comp. |
| 77 | R | 690 | 0.78 | 362 | 44 | 1.88 | 361 | 45 | 1.89 | 365 | 45 | 1.87 | Inv. |
| 78 | | 150 | 0.77 | 357 | 41 | 1.84 | 353 | 42 | 1.86 | 354 | 41 | 1.84 | Inv. |
| 79 | S | 680 | 0.39 | 403 | 38 | 1.46 | 401 | 40 | 1.67 | 403 | 37 | 1.41 | Comp. |
| 80 | | Room temp. | 0.46 | 405 | 35 | 1.24 | 403 | 34 | 1.26 | 403 | 34 | 1.26 | Comp. |

As is apparent from Table 13, the steels prepared according to the process of the present invention had excellent properties in the center portion of the coil, as well as in the portion at a distance of 10 m from the end. By contrast, for the comparative steels, the properties were remarkably deteriorated in the end portion of the coil, and, in the case of coiling at low temperatures, the properties were very poor over the whole length of the coil. Evidently, this tendency is more significant in positions nearer to the end portion.

Example 7

The influence of the heating temperature in hot rolling on the properties of the materials after cold rolling and annealing was investigated using steels B and K (slabs tapped from an actual equipment) listed in Tables 9 and 10. The slabs were heated to 1100 to 1350° C. using an actual equipment and hot rolled under conditions of finishing temperature 940° C. and sheet thickness 4.0 mm. The average cooling rate on a run out table was about 30° C./sec, and the hot rolled steel strips were then coiled at 620° C. The whole length of the coil was about 200 m. Samples were taken off from the same positions as described above in connection with Example 2, pickled, cold rolled to 0.8 mm, and subjected to heat treatment corresponding to continuous annealing in a laboratory. Annealing conditions were as follows. Annealing temp.: 790° C., soaking: 60 sec, cooling rate: 60° C./sec in cooling to room temp. Thereafter, the samples were temper rolled with a reduction ratio of 0.8% and used for a tensile test. The test results are summarized in Table 14.

TABLE 14

| | | Heating | 10 m from front end | | | Center | | | 10 m from rear end | | | |
|---|---|---|---|---|---|---|---|---|---|---|---|---|
| No. | Steel | temp., ° C. | TS, MPa | El, % | r | TS, MPa | El, % | r | TS, MPa | El, % | r | Remarks |
| 81 | B | 1100 | 300 | 53 | 2.15 | 296 | 53 | 2.16 | 297 | 53 | 2.18 | Inv. |
| 82 | | 1150 | 303 | 52 | 2.17 | 296 | 53 | 2.16 | 300 | 52 | 2.17 | Inv. |
| 83 | | 1200 | 305 | 51 | 2.15 | 300 | 53 | 2.15 | 303 | 52 | 2.16 | Inv. |
| 84 | | 1250 | 310 | 51 | 2.1 | 305 | 52 | 2.13 | 306 | 51 | 2.13 | Inv. |
| 85 | | 1300 | 313 | 46 | 1.75 | 307 | 47 | 1.73 | 312 | 46 | 1.69 | Comp. |
| 86 | | 1350 | 317 | 39 | 1.53 | 313 | 44 | 1.49 | 313 | 44 | 1.62 | Comp. |
| 87 | K | 1100 | 404 | 44 | 1.87 | 405 | 45 | 1.88 | 403 | 44 | 1.86 | Inv. |
| 88 | | 1150 | 407 | 44 | 1.87 | 406 | 43 | 1.86 | 404 | 43 | 1.85 | Inv. |
| 89 | | 1200 | 410 | 43 | 1.85 | 411 | 42 | 1.86 | 408 | 41 | 1.84 | Inv. |
| 90 | | 1250 | 413 | 42 | 1.83 | 412 | 42 | 1.83 | 410 | 40 | 1.83 | Inv. |
| 91 | | 1300 | 416 | 36 | 1.69 | 414 | 37 | 1.62 | 413 | 35 | 1.6 | Comp. |
| 92 | | 1350 | 417 | 33 | 1.48 | 415 | 33 | 1.36 | 413 | 31 | 1.36 | Comp. |

As is apparent from Table 14, the steels prepared according to the process of the present invention had excellent properties after cold rolling and annealing in the center portion of the hot rolled coil, as well as in the end portions. By contrast, when the heating temperature was above 1250°

C., the properties after cold rolling and annealing were remarkably deteriorated in the end portions of the coil.

Example 8

Steels A, E, G, I, L, M, Q, and T listed in Tables 9 and 10 were hot rolled in the same manner as in Example 5 (coiling temperature: 450° C.), subsequently pickled using an actual equipment, cold rolled with a reduction ratio of 80%, and passed through a continuous galvanizing line of in-line annealing system. In this case, the cold rolled strips were heated at the maximum heating temperature 820° C., cooled, subjected to conventional galvanizing (Al concentration of plating bath: 0.12%) at 470° C., and further alloyed by heating at 550° C. for about 15 sec. Thereafter, they were temper rolled at a reduction ratio of 0.7% and evaluated for mechanical properties and adhesion of plating. The results are summarized in Table 15.

Regarding the adhesion of plating, a sample was bent at 180° C. to close contact, and the peeling of the zinc coating was judged by adhering a pressure-sensitive tape to the bent portion and then peeling the tape, and determining the amount of the peeled plating adhered to the tape. The adhesion of plating was evaluated based on the following five grades.

1: large peeling, 2: medium peeling, 3: small peeling, 4: very small peeling, and 5: no peeling.

TABLE 15

| | | 10 m from front end | | | | Center | | | | 10 m from rear end | | | | |
|---|---|---|---|---|---|---|---|---|---|---|---|---|---|---|
| No. | Steel | TS, MPa | El, % | r | Adhesion of plating | TS, MPa | El, % | r | Adhesion of plating | TS, MPa | El, % | r | Adhesion of plating | Remarks |
| 93 | A | 304 | 5 | 2.20 | 5 | 303 | 50 | 2.18 | 5 | 305 | 50 | 2.18 | 4 | Inv. |
| 94 | E | 334 | 41 | 1.13 | 4 | 333 | 42 | 1.40 | 5 | 335 | 41 | 1.21 | 5 | Comp. |
| 95 | G | 289 | 50 | 2.08 | 4 | 289 | 52 | 2.10 | 5 | 290 | 51 | 2.08 | 5 | Inv. |
| 96 | I | 303 | 43 | 1.39 | 5 | 306 | 44 | 1.40 | 4 | 303 | 43 | 1.42 | 4 | Comp. |
| 97 | L | 307 | 53 | 2.05 | 5 | 310 | 49 | 2.06 | 5 | 309 | 50 | 2.00 | 5 | Inv. |
| 98 | M | 294 | 44 | 1.24 | 3 | 296 | 43 | 1.21 | 3 | 297 | 44 | 1.21 | 4 | Comp. |
| 99 | Q | 407 | 40 | 1.77 | 5 | 403 | 41 | 1.80 | 4 | 406 | 39 | 1.78 | 5 | Inv. |
| 100 | T | 392 | 30 | 1.15 | 4 | 389 | 32 | 1.13 | 5 | 387 | 32 | 1.13 | 4 | Comp. |

As is apparent from Table 15, the alloyed, galvanized steel sheets according to the process of the present invention had excellent properties independently of sites of the coils. By contrast, for the comparative steels, a variation in workability was observed from site to site. Further, like steel M, when the Nb content was low, the adhesion of plating was also deteriorated.

Example 9

Ultra low carbon steels, with Ti added thereto, having chemical compositions specified in Table 16, Table 17 (continuation of Table 16: part 1), Table 18 (continuation of Table 16: part 2), and Table 19 (continuation of Table 16: part 3) were tapped from a converter and cast by means of a continuous casting machine into slabs which were then hot rolled under conditions as indicated in Table 20, Table 22 (continuation of Table 20: part 2), Table 25 (continuation of Table 20: part 5), and Table 28 (continuation of Table 20: part 8) and coiled at different temperatures. Samples were taken off from the center portion in the longitudinal direction of the hot rolled coils and treated as follows. Specifically, they were pickled, cold rolled to 0.8 mm, and subjected to heat treatment corresponding to continuous annealing. Annealing conditions were as indicated in Table 20, Table 23 (continuation of Table 20: part 3), Table 26 (continuation of Table 20: part 6), and Table 29 (continuation of Table 20: part 9). Thereafter, the samples were then temper rolled with reduction ratios as indicated in Table 21 (continuation of Table 20: part 1), Table 24 (continuation of Table 20: part 4), Table 27 (continuation of Table 20: part 7), and Table 30 (continuation of Table 20: part 10) and used for a tensile test. The tensile test and the measurement of average Lankford value (hereinafter referred to as "r value") were carried out using a JIS No. 5 test piece. The r value was evaluated at an elongation of 15% and calculated by the following equation based on values for rolling direction (direction L), direction perpendicular to the rolling direction (direction C), and direction at 45° to the rolling direction (direction D).

$$r=(r_L+2r_D+r_c)/4$$

The test results are summarized in Tables 21, 24, 27 and 30.

TABLE 16

(wt %)

| Steel No. | C | Si | Mn | P | S | Al | Ti | Remarks |
|---|---|---|---|---|---|---|---|---|
| 1 | 0.0008 | 0.02 | 0.06 | 0.013 | 0.004 | 0.04 | 0.018 | Steel of Inv. |
| 2 | 0.0041 | 0.01 | 0.13 | 0.008 | 0.01 | 0.04 | 0.065 | Steel of Inv. |
| 3 | 0.0019 | 0.01 | 0.1 | 0.009 | 0.004 | 0.05 | 0.009 | Comp. steel |
| 4 | 0.0028 | 0.01 | 0.09 | 0.007 | 0.009 | 0.04 | 0.055 | Steel of inv. |
| 5 | 0.003 | 0.02 | 0.25 | 0.007 | 0.011 | 0.03 | 0.053 | Comp. steel |
| 6 | 0.0018 | 0.01 | 0.05 | 0.01 | 0.005 | 0.05 | 0.026 | Steel of inv. |
| 7 | 0.0022 | 0.03 | 0.24 | 0.008 | 0.011 | 0.04 | 0.028 | Comp. steel |
| 8 | 0.0034 | 0.01 | 0.11 | 0.012 | 0.016 | 0.03 | 0.062 | Steel of inv. |
| 9 | 0.0036 | 0.02 | 0.14 | 0.006 | 0.024 | 0.04 | 0.043 | Comp. steel |

TABLE 17

(Continuation of Table 16: part 1)

(wt %)

| Steel No. | B | N | Ti* | Ti*/S | K | Remarks |
|---|---|---|---|---|---|---|
| 1 | 0.0003 | 0.0018 | 0.0118 | 2.96 | 0.09 | Steel of Inv. |
| 2 | — | 0.0026 | 0.0561 | 5.61 | 0.05 | Steel of Inv. |
| 3 | — | 0.0015 | 0.0039 | 0.97 | 0.06 | Comp. steel |
| 4 | — | 0.0023 | 0.0471 | 5.24 | 0.02 | Steel of inv. |
| 5 | — | 0.0022 | 0.0455 | 4.13 | 0.28 | Comp. steel |
| 6 | 0.0005 | 0.0026 | 0.0171 | 3.42 | 0.18 | Steel of inv. |
| 7 | 0.0003 | 0.0019 | 0.0215 | 1.95 | 0.55 | Comp. steel |
| 8 | 0.0006 | 0.0025 | 0.0535 | 3.34 | 0.09 | Steel of inv. |
| 9 | 0.0002 | 0.0027 | 0.0338 | 1.41 | 0.15 | Comp. steel |

Ti* = Ti—3.42N
K = (% S as MnS)/(% total S)

TABLE 18

(Continuation of Table 16: part 2)

(wt %)

| Steel No. | C | Si | Mn | P | S | Al | Ti | Remarks |
|---|---|---|---|---|---|---|---|---|
| 10 | 0.0023 | 0.05 | 0.13 | 0.055 | 0.014 | 0.04 | 0.056 | Steel of Inv. |
| 11 | 0.003 | 0.25 | 0.06 | 0.036 | 0.005 | 0.04 | 0.033 | Steel of Inv. |
| 12 | 0.0025 | 0.06 | 0.24 | 0.045 | 0.01 | 0.03 | 0.038 | Comp. steel |
| 13 | 0.0016 | 0.28 | 0.1 | 0.078 | 0.011 | 0.04 | 0.061 | Steel of inv. |
| 14 | 0.0024 | 0.23 | 0.11 | 0.082 | 0.016 | 0.06 | 0.021 | Comp. steel |
| 15 | 0.0038 | 0.75 | 0.1 | 0.06 | 0.015 | 0.04 | 0.065 | Steel of inv. |
| 16 | 0.0009 | 0.31 | 0.04 | 0.116 | 0.005 | 0.04 | 0.022 | Steel of inv. |
| 17 | 0.0019 | 0.15 | 1.22 | 0.08 | 0.007 | 0.05 | 0.045 | Comp. steel |
| 18 | 0.0033 | 0.03 | 0.07 | 0.06 | 0.012 | 0.03 | 0.052 | Steel of inv. |
| 19 | 0.0024 | 0.04 | 0.1 | 0.058 | 0.007 | 0.04 | 0.028 | Steel of inv. |

TABLE 18-continued (Continuation of Table 16: part 2)

(wt %)

| Steel No. | C | Si | Mn | P | S | Al | Ti | Remarks |
|---|---|---|---|---|---|---|---|---|
| 20 | 0.0026 | 0.02 | 0.27 | 0.049 | 0.011 | 0.05 | 0.045 | Comp. steel |
| 21 | 0.0018 | 0.25 | 0.12 | 0.086 | 0.01 | 0.05 | 0.054 | Steel of inv. |
| 22 | 0.0034 | 0.62 | 0.13 | 0.095 | 0.006 | 0.04 | 0.042 | Steel of inv. |
| 23 | 0.0022 | 0.75 | 0.13 | 0.088 | 0.02i | 0.04 | 0.038 | Comp. steel |

TABLE 19

(Continuation of Table 16: part 3)

(wt %)

| Steel No. | B | N | Ti* | Ti*/S | K | Remarks |
|---|---|---|---|---|---|---|
| 10 | — | 0.002 | 0.0492 | 3.51 | 0.05 | Steel of Inv. |
| 11 | 0.0006 | 0.0018 | 0.0268 | 3.36 | 0.09 | Steel of Inv. |
| 12 | 0.0002 | 0.0024 | 0.0298 | 2.98 | 0.36 | Comp. steel |
| 13 | 0.0004 | 0.0027 | 0.0518 | 4.71 | 0.07 | Steel of inv. |
| 14 | 0.0002 | 0.0026 | 0.0121 | 0.76 | 0.18 | Comp. steel |
| 15 | — | 0.0024 | 0.0568 | 3.79 | 0.04 | Steel of inv. |
| 16 | 0.0007 | 0.0016 | 0.0165 | 3.31 | 0.03 | Steel of inv. |
| 17 | 0.0003 | 0.002 | 0.0382 | 5.45 | 0.95 | Comp. steel |
| 18 | — | 0.0019 | 0.0455 | 3.79 | 0.01 | Steel of inv. |
| 19 | 0.0005 | 0.0025 | 0.0195 | 2.78 | 0.11 | Steel of inv. |
| 20 | 0.0003 | 0.0028 | 0.0354 | 3.22 | 0.32 | Comp. steel |
| 21 | 0.0004 | 0.003 | 0.0437 | 4.37 | 0.04 | Steel of inv. |
| 22 | 0.0005 | 0.0017 | 0.0362 | 6.03 | 0.06 | Steel of inv. |
| 23 | 0.0005 | 0.0026 | 0.0291 | 1.39 | 0.32 | Comp. steel |

Ti* = Ti—3.42N
K = (% S as MnS)/(% total S)

TABLE 20

| | Rolling conditions | | | Annealing conditions | | |
|---|---|---|---|---|---|---|
| Steel No. | Heating temp., ° C. | Finishing temp., ° C. | Cooling rate, ° C./sec | Temp. (° C.) × time (sec) | Cooling rate, ° C./sec | Remarks |
| 1 | 1100 | 920 | 40 | 770 × 40 | 60 | Inv. |
| 1 | 1100 | 920 | 40 | 770 × 40 | 60 | Inv. |
| 1 | 1100 | 920 | 40 | 770 × 40 | 60 | Inv. |
| 2 | 1100 | 920 | 40 | 770 × 40 | 60 | Inv. |
| 2 | 1100 | 920 | 40 | 770 × 40 | 60 | Inv. |
| 2 | 1100 | 920 | 40 | 770 × 40 | 60 | Inv. |
| 3 | 1100 | 920 | 40 | 770 × 40 | 60 | Comp. |
| 3 | 1100 | 920 | 40 | 770 × 40 | 60 | Comp. |
| 3 | 1100 | 920 | 40 | 770 × 40 | 60 | Comp. |

TABLE 21

(Continuation of Table 20: part 1)

| Steel No. | Temper rolling reduction ratio, % | Coiling temp., ° C. | Content of C as carbide, ppm | TS, MPa | El, % | r | Remarks |
|---|---|---|---|---|---|---|---|
| 1 | 0.8 | 700 | 5 | 302 | 52 | 2.12 | Inv. |
| 1 | 0.8 | 500 | 3 | 300 | 52 | 2.13 | Inv. |
| 1 | 0.8 | Room temp. | 1 | 300 | 53 | 2.15 | Inv. |
| 2 | 0.8 | 710 | 4 | 324 | 50 | 1.89 | Inv. |
| 2 | 0.8 | 460 | 2 | 323 | 50 | 1.92 | Inv. |
| 2 | 0.8 | 80 | 0 | 325 | 51 | 1.93 | Inv. |
| 3 | 0.8 | 700 | 9 | 297 | 46 | 1.36 | Comp. |

TABLE 21-continued (Continuation of Table 20: part 1)

| Steel No. | Temper rolling reduction ratio, % | Coiling temp., ° C. | Content of C as carbide, ppm | TS, MPa | El, % | r | Remarks |
|---|---|---|---|---|---|---|---|
| 3 | 0.8 | 320 | 4 | 296 | 45 | 1.17 | Comp. |
| 3 | 0.8 | 150 | 3 | 300 | 42 | 1.09 | Comp. |

TABLE 22

(Continuation of Table 20: part 2)

| | Rolling conditions | | | |
|---|---|---|---|---|
| Steel No. | Heating temp., ° C. | Finishing temp., ° C. | Cooling rate, ° C./sec | Remarks |
| 4 | 1080 | 910 | 20 | Inv. |
| 4 | 1080 | 910 | 20 | Inv. |
| 4 | 1080 | 910 | 20 | Inv. |
| 5 | 1080 | 910 | 20 | Comp. |
| 5 | 1080 | 910 | 20 | Comp. |
| 5 | 1080 | 910 | 20 | Comp. |
| 6 | 1080 | 910 | 20 | Inv. |
| 6 | 1080 | 910 | 20 | Inv. |
| 6 | 1080 | 910 | 20 | Inv. |
| 7 | 1080 | 910 | 20 | Comp. |
| 7 | 1080 | 910 | 20 | Comp. |
| 7 | 1080 | 910 | 20 | Comp. |
| 8 | 1080 | 910 | 20 | Inv. |
| 8 | 1080 | 910 | 20 | Inv. |
| 8 | 1080 | 910 | 20 | Inv. |
| 9 | 1080 | 910 | 20 | Comp. |
| 9 | 1080 | 910 | 20 | Comp. |
| 9 | 1080 | 910 | 40 | Comp. |

TABLE 23

(Continuation of Table 20: part 3)

| | Annealing conditions | | |
|---|---|---|---|
| Steel No. | Temp. (° C.) × time (sec) | Cooling rate, ° C./sec | Remarks |
| 4 | 810 × 40 | 5° C./sec → 670° C. → 50° C./sec | Inv. |
| 4 | 810 × 40 | 5° C./sec → 670° C. → 50° C./sec | Inv. |
| 4 | 810 × 40 | 5° C./sec → 670° C. → 50° C./sec | Inv. |
| 5 | 810 × 40 | 5° C./sec → 670° C. → 50° C./sec | Comp. |
| 5 | 810 × 40 | 5° C./sec → 670° C. → 50° C./sec | Comp. |
| 5 | 810 × 40 | 5° C./sec → 670° C. → 50° C./sec | Comp. |
| 6 | 810 × 40 | 5° C./sec → 670° C. → 50° C./sec | Inv. |
| 6 | 810 × 40 | 5° C./sec → 670° C. → 50° C./sec | Inv. |
| 6 | 810 × 40 | 5° C./sec → 670° C. → 50° C.Isec | Inv. |
| 7 | 810 × 40 | 5° C./sec → 670° C. → 50° C./sec | Comp. |
| 7 | 810 × 40 | 5° C./sec → 670° C. → 50° C./sec | Comp. |
| 7 | 810 × 40 | 5° C./sec → 670° C. → 50° C./sec | Comp. |
| 8 | 810 × 40 | 5° C./sec → 670° C. → 50° C./sec | Inv. |
| 8 | 810 × 40 | 5° C./sec → 670° C. → 50° C./sec | Inv. |
| 8 | 810 × 40 | 5° C./sec → 670° C. → 50° C./sec | Inv. |
| 9 | 810 × 40 | 5° C./sec → 670° C. → 50° C./sec | Comp. |
| 9 | 810 × 40 | 5° C./sec → 670° C. → 50° C./sec | Comp. |
| 9 | 810 × 40 | 5° C./sec → 670° C. → 50° C./sec | Comp. |

TABLE 24

(Continuation of Table 20: part 4)

| Steel No. | Temper rolling reduction ratio, % | Coiling temp., ° C. | Content of C as carbide, ppm | TS, MPa | El, % | r | Remarks |
|---|---|---|---|---|---|---|---|
| 4 | 0.8 | 710 | 5 | 302 | 47 | 1.65 | Inv. |
| 4 | 0.8 | 640 | 2 | 292 | 50 | 1.78 | Inv. |
| 4 | 0.8 | Room temp. | 1 | 290 | 51 | 1.82 | Inv. |
| 5 | 0.8 | 710 | 18 | 310 | 46 | 1.63 | Comp. |
| 5 | 0.8 | 640 | 5 | 308 | 44 | 1.42 | Comp. |
| 5 | 0.8 | Room temp. | 2 | 315 | 43 | 1.33 | Comp. |
| 6 | 0.8 | 690 | 4 | 288 | 48 | 1.61 | Inv. |
| 6 | 0.8 | 530 | 0 | 285 | 52 | 1.75 | Inv. |
| 6 | 0.8 | 80 | 0 | 287 | 51 | 1.77 | Inv. |
| 7 | 0.8 | 700 | 8 | 295 | 47 | 1.69 | Comp. |
| 7 | 0.8 | 520 | 2 | 298 | 45 | 1.49 | Comp. |
| 7 | 0.8 | 70 | 1 | 296 | 45 | 1.46 | Comp. |
| 8 | 0.8 | 750 | 6 | 320 | 46 | 1.78 | Inv. |
| 8 | 0.8 | 610 | 2 | 316 | 47 | 1.91 | Inv. |
| 8 | 0.8 | 460 | 1 | 310 | 46 | 1.88 | Inv. |
| 9 | 0.8 | 760 | 20 | 326 | 45 | 1.47 | Comp. |

TABLE 24-continued (Continuation of Table 20: part 4)

| Steel No. | Temper rolling reduction ratio, % | Coiling temp., ° C. | Content of C as carbide, ppm | TS, MPa | El, % | r | Remarks |
|---|---|---|---|---|---|---|---|
| 9 | 0.8 | 600 | 4 | 321 | 42 | 1.24 | Comp. |
| 9 | 0.8 | 450 | 3 | 317 | 43 | 1.26 | Comp. |

TABLE 25

(Continuation of Table 20: part 5)

| Steel No. | Rolling conditions: Heating temp., ° C. | Finishing temp., ° C. | Cooling rate, ° C./sec | Remarks |
|---|---|---|---|---|
| 10 | 1080 | 940 | 30 | Inv. |
| 10 | 1080 | 940 | 30 | Inv. |
| 10 | 1080 | 940 | 30 | Inv. |
| 11 | 1080 | 940 | 30 | Inv. |
| 11 | 1080 | 940 | 30 | Inv. |
| 11 | 1080 | 940 | 30 | Inv. |
| 12 | 1080 | 940 | 30 | Comp. |
| 12 | 1080 | 940 | 30 | Comp. |
| 12 | 1080 | 940 | 30 | Comp. |
| 13 | 1080 | 940 | 30 | Inv. |
| 13 | 1080 | 940 | 30 | Inv. |
| 13 | 1080 | 940 | 30 | Inv. |
| 14 | 1080 | 940 | 30 | Comp. |
| 14 | 1080 | 940 | 30 | Comp. |
| 14 | 1080 | 940 | 30 | Comp. |
| 15 | 1080 | 940 | 30 | Inv. |
| 15 | 1080 | 940 | 30 | Inv. |
| 15 | 1080 | 940 | 30 | Inv. |
| 16 | 1080 | 940 | 30 | Inv. |
| 16 | 1080 | 940 | 30 | Inv. |
| 16 | 1080 | 940 | 30 | Inv. |
| 17 | 1080 | 940 | 30 | Comp. |
| 17 | 1080 | 940 | 30 | Comp. |
| 17 | 1080 | 940 | 30 | Comp. |

TABLE 26

(Continuation of Table 20: part 6)

| Steel No. | Annealing conditions: Temp. (° C.) × time (sec) | Cooling rate, ° C./sec | Remarks |
|---|---|---|---|
| 10 | 820 × 60 | 4° C./sec → 670° C. → 70° C./sec | Inv. |
| 10 | 820 × 60 | 4° C./sec → 670° C. → 70° C./sec | Inv. |
| 10 | 820 × 60 | 4° C./sec → 670° C. → 7O° C./sec | Inv. |
| 11 | 820 × 60 | 4° C./sec → 670° C. → 70° C./sec | Inv. |
| 11 | 820 × 60 | 4° C./sec → 670° C. → 70° C./sec | Inv. |
| 11 | 820 × 60 | 4° C./sec → 670° C. → 70° C./sec | Inv. |
| 12 | 820 × 60 | 4° C./sec → 670° C. → 70° C./sec | Comp. |
| 12 | 820 × 60 | 4° C./sec → 670° C. → 70° C./sec | Comp. |
| 12 | 820 × 60 | 4° C./sec → 670° C. → 70° C./sec | Comp. |
| 13 | 820 × 60 | 4° C./sec → 670° C. → 70° C./sec | Inv. |
| 13 | 820 × 60 | 4° C./sec → 670° C. → 70° C./sec | Inv. |
| 13 | 820 × 60 | 4° C./sec → 670° C. → 70° C./sec | Inv. |
| 14 | 820 × 60 | 4° C./sec → 670° C. → 70° C./sec | Comp. |
| 14 | 820 × 60 | 4° C./sec → 670° C. → 70° C./sec | Comp. |
| 14 | 820 × 60 | 4° C./sec → 670° C. → 70° C./sec | Comp. |
| 15 | 820 × 60 | 4° C./sec → 670° C. → 70° C./sec | Inv. |
| 15 | 820 × 60 | 4° C./sec → 670° C. → 70° C./sec | Inv. |
| 15 | 820 × 60 | 4° C./sec → 670° C. → 70° C./sec | Inv. |
| 16 | 820 × 60 | 4° C./sec → 670° C. → 70° C./sec | Inv. |
| 16 | 820 × 60 | 4° C./sec → 670° C. → 70° C./sec | Inv. |
| 16 | 820 × 60 | 4° C./sec → 670° C. → 70° C./sec | Inv. |
| 17 | 820 × 60 | 4° C./sec → 670° C. → 70° C./sec | Comp. |
| 17 | 820 × 60 | 4° C./sec → 670° C. → 70° C./sec | Comp. |
| 17 | 820 × 60 | 4° C./sec → 670° C. → 70° C./sec | Comp. |

TABLE 27

(Continuation of Table 20: part 7)

| Steel No. | Temper rolling reduction ratio, % | Coiling temp., ° C. | Content of C as carbide, ppm | TS, MPa | El, % | r | Remarks |
|---|---|---|---|---|---|---|---|
| 10 | 0.8 | 710 | 4 | 353 | 45 | 1.82 | Inv. |
| 10 | 0.8 | 650 | 1 | 352 | 45 | 1.83 | Inv. |
| 10 | 0.8 | 180 | 0 | 350 | 44 | 1.82 | Inv. |
| 11 | 0.8 | 720 | 3 | 348 | 46 | 1.71 | Inv. |
| 11 | 0.8 | 520 | 1 | 348 | 47 | 1.74 | Inv. |
| 11 | 0.8 | 200 | 0 | 345 | 46 | 1.73 | Inv. |
| 12 | 0.8 | 710 | 8 | 345 | 45 | 1.67 | Comp. |
| 12 | 0.8 | 460 | 1 | 345 | 43 | 1.41 | Comp. |
| 12 | 0.8 | 150 | 0 | 342 | 40 | 1.21 | Comp. |

TABLE 27-continued (Continuation of Table 20: part 7)

| Steel No. | Temper rolling reduction ratio, % | Coiling temp., ° C. | Content of C as carbide, ppm | TS, MPa | El, % | r | Remarks |
|---|---|---|---|---|---|---|---|
| 13 | 0.8 | 730 | 5 | 412 | 39 | 1.78 | Inv. |
| 13 | 0.8 | 520 | 1 | 410 | 39 | 1.81 | Inv. |
| 13 | 0.8 | 100 | 1 | 408 | 41 | 1.81 | Inv. |
| 14 | 0.8 | 720 | 7 | 409 | 39 | 1.53 | Comp. |
| 14 | 0.8 | 360 | 3 | 405 | 37 | 1.41 | Comp. |
| 14 | 0.8 | Room temp. | 0 | 401 | 35 | 1.15 | Comp. |
| 15 | 0.8 | 730 | 2 | 455 | 35 | 1.82 | Inv. |
| 15 | 0.8 | 450 | 0 | 452 | 37 | 1.82 | Inv. |
| 15 | 0.8 | 180 | 0 | 452 | 36 | 1.79 | Inv. |
| 16 | 0.8 | 730 | 4 | 463 | 34 | 1.67 | Inv. |
| 16 | 0.8 | 380 | 1 | 460 | 35 | 1.7 | Inv. |
| 16 | 0.8 | 80 | 0 | 458 | 36 | 1.68 | Inv. |
| 17 | 0.8 | 730 | 8 | 445 | 36 | 1.68 | Comp. |
| 17 | 0.8 | 560 | 3 | 446 | 35 | 1.51 | Comp. |
| 17 | 0.8 | 150 | 0 | 445 | 33 | 1.21 | Comp. |

TABLE 28

(Continuation of Table 20: part 8)

| | Rolling conditions | | | |
|---|---|---|---|---|
| Steel No. | Heating temp., ° C. | Finishing temp., ° C. | Cooling rate, ° C./sec | Remarks |
| 18 | 1120 | 950 | 20 | Inv. |
| 18 | 1120 | 950 | 20 | Inv. |
| 18 | 1120 | 950 | 20 | Inv. |
| 19 | 1120 | 950 | 20 | Inv. |
| 19 | 1120 | 950 | 20 | Inv. |
| 19 | 1120 | 950 | 20 | Inv. |
| 20 | 1120 | 950 | 20 | Comp. |
| 20 | 1120 | 950 | 20 | Comp. |
| 20 | 1120 | 950 | 20 | Comp. |
| 21 | 1120 | 950 | 20 | Inv. |
| 21 | 1120 | 950 | 20 | Inv. |
| 21 | 1120 | 950 | 20 | Inv. |
| 22 | 1120 | 950 | 20 | Inv. |
| 22 | 1120 | 950 | 20 | Inv. |
| 22 | 1120 | 950 | 20 | Inv. |
| 23 | 1120 | 950 | 20 | Comp. |
| 23 | 1120 | 950 | 20 | Comp. |
| 23 | 1120 | 950 | 20 | Comp. |

TABLE 29

(Continuation of Table 20: part 9)

| | Annealing conditions | | |
|---|---|---|---|
| Steel No. | Temp. (° C.) × time (sec) | Cooling rate, ° C./sec | Remarks |
| 18 | 800 × 50 | 5° C./sec → 700° C. → 50° C./sec | Inv. |
| 18 | 800 × 50 | 5° C./sec → 700° C. → 50° C./sec | Inv. |
| 18 | 800 × 50 | 5° C./sec → 700° C. → 50° C./sec | Inv. |
| 19 | 800 × 50 | 5° C./sec → 700° C. → 50° C./sec | Inv. |
| 19 | 800 × 50 | 5° C./sec → 700° C. → 50° C./sec | Inv. |
| 19 | 800 × 50 | 5° C./sec → 700° C. → 50° C./sec | Inv. |
| 20 | 800 × 50 | 5° C./sec → 700° C. → 50° C./sec | Comp. |
| 20 | 800 × 50 | 5° C./sec → 700° C. → 50° C./sec | Comp. |
| 20 | 800 × 50 | 5° C./sec → 700° C. → 50° C./sec | Comp. |
| 21 | 800 × 50 | 5° C./sec → 700° C. → 50° C./sec | Inv. |
| 21 | 800 × 50 | 5° C./sec → 700° C. → 50° C./sec | Inv. |
| 21 | 800 × 50 | 5° C./sec → 700° C. → 50° C./sec | Inv. |
| 22 | 800 × 50 | 5° C./sec → 700° C. → 50° C./sec | Inv. |
| 22 | 800 × 50 | 5° C./sec → 700° C. → 50° C./sec | Inv. |
| 22 | 800 × 50 | 5° C./sec → 700° C. → 50° C./sec | Inv. |
| 23 | 800 × 50 | 5° C./sec → 700° C. → 50° C./sec | Comp. |
| 23 | 800 × 50 | 5° C./sec → 700° C. → 50° C./sec | Comp. |
| 23 | 800 × 50 | 5° C./sec → 700° C. → 50° C./sec | Comp. |

TABLE 30

(Continuation of Table 20: part 10)

| Steel No. | Temper rolling reduction ratio, % | Coiling temp., ° C. | Content of C as carbide, ppm | TS, MPa | El, % | r | Remarks |
|---|---|---|---|---|---|---|---|
| 18 | 0.8 | 720 | 4 | 363 | 44 | 1.66 | Inv. |
| 18 | 0.8 | 630 | 0 | 358 | 45 | 1.81 | Inv. |

TABLE 30-continued (Continuation of Table 20: part 10)

| Steel No. | Temper rolling reduction ratio, % | Coiling temp., ° C. | Content of C as carbide, ppm | TS, MPa | El, % | r | Remarks |
|---|---|---|---|---|---|---|---|
| 18 | 0.8 | 80 | 0 | 355 | 45 | 1.82 | Inv. |
| 19 | 0.8 | 680 | 5 | 357 | 45 | 1.54 | Inv. |
| 19 | 0.8 | 510 | 1 | 350 | 46 | 1.68 | Inv. |
| 19 | 0.8 | Room temp. | 1 | 352 | 45 | 1.7 | Inv. |
| 20 | 0.8 | 700 | 8 | 359 | 44 | 1.69 | Comp. |
| 20 | 0.8 | 640 | 2 | 350 | 45 | 1.47 | Comp. |
| 20 | 0.8 | 80 | 0 | 349 | 45 | 1.39 | Comp. |
| 21 | 0.8 | 750 | 3 | 407 | 40 | 1.58 | Inv. |
| 21 | 0.8 | 300 | 0 | 405 | 40 | 1.79 | Inv. |
| 21 | 0.8 | 140 | 0 | 406 | 40 | 1.77 | Iny. |
| 22 | 0.8 | 730 | 3 | 455 | 34 | 1.64 | Inv. |
| 22 | 0.8 | 620 | 0 | 449 | 35 | 1.74 | Inv. |
| 22 | 0.8 | 500 | 0 | 451 | 35 | 1.74 | Inv. |
| 23 | 0.8 | 730 | 12 | 460 | 33 | 1.49 | Comp. |
| 23 | 0.8 | 620 | 3 | 455 | 34 | 1.23 | Comp. |
| 23 | 0.8 | 510 | 1 | 460 | 34 | 1.28 | Comp. |

As is apparent from Tables 20 to 30, for steels having compositions falling within the scope of the present invention, coiling at a temperature of 800° C. or below offers good properties. In particular, when the coiling temperature could be lowered to reduce the amount of C precipitated as carbide to not more than 0.0003%, very good properties could be obtained. On the other hand, for the comparative steels, it is evident that coiling at low temperatures results in very poor properties.

Example 10

Cold rolled steel sheets (hot rolling to a thickness of 4 mm followed by cold rolling to a thickness of 0.8 mm) produced under conditions as indicated in Table 31 and Table 33 (continuation of Table 31: part 2) from steel Nos. 1, 2, 3, 4, 5, 6, 7, 10, 12, 13, 18 and 20 listed in Tables 16 to 19 were used to investigate the properties of the materials in the longitudinal direction of the cold rolled coils.

The test results are summarized in Table 32 (continuation of Table 31: part 1) and Table 34 (continuation of Table 31: part 3).

TABLE 31

| | Production conditions | | | | | | | |
|---|---|---|---|---|---|---|---|---|
| | Rolling conditions | | | Annealing conditions | | Temper | | |
| Steel No. | Heating temp., ° C. | Finishing temp., °C. | Cooling rate, ° C./sec | Temp. (° C.) × time (sec) | Cooling rate, ° C./sec | rolling reduction ratio, % | Coiling temp., ° C. | Remarks |
| 1 | 1120 | 900 | 40 | 830 × 50 | 5° C./s → 680° C. → 50° C./s | 0.5 | 700 | Inv. |
| 1 | 1120 | 900 | 40 | 830 × 50 | 5° C./s → 680° C. → 50° C./s | 0.5 | 80 | Inv. |
| 2 | 1120 | 900 | 40 | 830 × 50 | 5° C./s → 680° C. → 50° C./s | 0.5 | 700 | Inv. |
| 2 | 1120 | 900 | 40 | 830 × 50 | 5° C./s → 680° C. → 50° C./s | 0.5 | 100 | Inv. |
| 3 | 1120 | 900 | 40 | 830 × 50 | 5° C./s → 680° C. → 50° C./s | 0.5 | 700 | Comp. |
| 3 | 1120 | 900 | 40 | 830 × 50 | 5° C./s → 680° C. → 50° C./s | 0.5 | Room temp. | Comp. |
| 4 | 1080 | 910 | 20 | 810 × 40 | 5° C./s → 670° C. → 50° C./s | 0.8 | 640 | Inv. |
| 4 | 1080 | 910 | 20 | 810 × 40 | 5° C./s → 670° C. → 50° C./s | 0.8 | Room temp. | Inv. |
| 5 | 1080 | 910 | 20 | 810 × 40 | 5° C./s → 670° C. → 50° C./s | 0.8 | 640 | Comp. |
| 5 | 1080 | 910 | 20 | 810 × 40 | 5° C./s → 670° C. → 50° C./s | 0.8 | Room temp. | Comp. |
| 6 | 1080 | 910 | 20 | 810 × 40 | 5° C./s → 670° C. → 50° C./s | 0.8 | 530 | Inv. |
| 6 | 1080 | 910 | 20 | 810 × 40 | 5° C./s → 670° C. → 50° C./s | 0.8 | 80 | Inv. |
| 7 | 1080 | 910 | 20 | 810 × 40 | 5° C./s → 670° C. → 50° C./s | 0.8 | 700 | Comp. |
| 7 | 1080 | 910 | 20 | 810 × 40 | 5° C./s → 670° C. → 50° C./s | 0.8 | 70 | Comp. |

TABLE 32

(Continuation of Table 31: part 1)

| | Properties | | | | | | | | | | | | |
|---|---|---|---|---|---|---|---|---|---|---|---|---|---|
| | 10 m from front end | | | | Center | | | | 10 m from rear end | | | | |
| No. | Content of C as carbide, ppm | TS, MPa | El, % | r | Content of C as carbide, ppm | TS, MPa | El, % | r | Content of C as carbide, ppm | TS, MPa | El, % | r | Remarks |
| 1 | 1 | 303 | 51 | 2.1 | 2 | 305 | 51 | 2.11 | 1 | 306 | 51 | 2.13 | Inv. |
| 1 | 0 | 305 | 52 | 2.1 | 0 | 301 | 50 | 2.12 | 0 | 305 | 50 | 2.07 | Inv. |
| 2 | 0 | 325 | 49 | 1.9 | 4 | 327 | 49 | 1.88 | 2 | 327 | 49 | 1.89 | Inv. |
| 2 | 0 | 323 | 49 | 1.89 | 0 | 325 | 50 | 1.88 | 0 | 329 | 49 | 1.83 | Inv. |
| 3 | 1 | 290 | 45 | 1.33 | 3 | 297 | 46 | 1.37 | 2 | 294 | 46 | 1.36 | Comp. |
| 3 | 0 | 289 | 43 | 1.2 | 1 | 299 | 45 | 1.18 | 1 | 291 | 44 | 1.18 | Comp. |
| 4 | 2 | 294 | 50 | 1.8 | 2 | 292 | 50 | 1.78 | 2 | 288 | 51 | 1.81 | Inv. |
| 4 | 1 | 289 | 51 | 1.81 | 1 | 290 | 51 | 1.82 | 2 | 291 | 50 | 1.79 | Inv. |
| 5 | 3 | 310 | 44 | 1.27 | 5 | 308 | 44 | 1.42 | 4 | 307 | 44 | 1.31 | Comp. |
| 5 | 2 | 317 | 42 | 1.31 | 2 | 315 | 43 | 1.33 | 2 | 315 | 43 | 1.28 | Comp. |
| 6 | 0 | 293 | 51 | 1.67 | 0 | 294 | 51 | 1.69 | 0 | 296 | 50 | 1.66 | Inv. |
| 6 | 0 | 295 | 50 | 1.71 | 0 | 292 | 50 | 1.7 | 0 | 292 | 50 | 1.69 | Inv. |
| 7 | 3 | 311 | 44 | 1.4 | 8 | 308 | 45 | 1.6 | 2 | 311 | 43 | 1.35 | Comp. |
| 7 | 1 | 310 | 45 | 1.39 | 1 | 312 | 44 | 1.37 | 1 | 320 | 43 | 1.33 | Comp. |

TABLE 33

(Continuation of Table 31: part 2)

| | Production conditions | | | | | | | |
|---|---|---|---|---|---|---|---|---|
| | Rolling conditions | | | Annealing conditions | | Temper | | |
| Steel No. | Heating temp., ° C. | Finishing temp., °C. | Cooling rate, ° C./sec | Temp. (° C.) × time (sec) | Cooling rate, ° C./sec | rolling reduction ratio, % | Coiling temp., ° C. | Remarks |
| 10 | 1080 | 940 | 30 | 820 × 60 | 4° C./s → 670° C. → 70° C./s | 0.8 | 710 | Inv. |
| 10 | 1080 | 940 | 30 | 820 × 60 | 4° C./s → 670° C. → 70° C./s | 0.8 | 180 | Inv. |
| 12 | 1080 | 940 | 30 | 820 × 60 | 4° C./s → 670° C. → 70° C./s | 0.8 | 730 | Comp. |
| 12 | 1080 | 940 | 30 | 820 × 60 | 4° C./s → 670° C. → 70° C./s | 0.8 | 150 | Comp. |
| 13 | 1080 | 940 | 30 | 820 × 60 | 4° C./s → 670° C. → 70° C./s | 0.8 | 720 | Inv. |
| 13 | 1080 | 940 | 30 | 820 × 60 | 4° C./s → 670° C. → 70° C./s | 0.8 | 100 | Inv. |
| 18 | 1120 | 950 | 20 | 800 × 50 | 5° C./s → 700° C. → 50° C./s | 0.8 | 630 | Inv. |
| 18 | 1120 | 950 | 20 | 800 × 50 | 5° C./s → 700° C. → 50° C./s | 0.8 | 80 | Inv. |
| 20 | 1120 | 950 | 20 | 800 × 50 | 5° C./s → 700° C. → 50° C./s | 0.8 | 640 | Comp. |
| 20 | 1120 | 950 | 20 | 800 × 50 | 5° C./s → 700° C. → 50° C./s | 0.8 | 80 | Comp. |

TABLE 34

(Continuation of Table 31: part 3)

| | Properties | | | | | | | | | | | | |
|---|---|---|---|---|---|---|---|---|---|---|---|---|---|
| | 10 m from front end | | | | Center | | | | 10 m from rear end | | | | |
| No. | Content of C as carbide, ppm | TS, MPa | El, % | r | Content of C as carbide, ppm | TS, MPa | El, % | r | Content of C as carbide, ppm | TS, MPa | El, % | r | Remarks |
| 10 | 0 | 356 | 44 | 1.77 | 4 | 353 | 45 | 1.82 | 1 | 352 | 45 | 1.85 | Inv. |
| 10 | 0 | 355 | 45 | 1.8 | 0 | 350 | 44 | 1.82 | 0 | 350 | 44 | 1.84 | Inv. |
| 12 | 3 | 355 | 44 | 1.24 | 8 | 345 | 45 | 1.67 | 3 | 360 | 43 | 1.31 | Comp. |
| 12 | 1 | 354 | 43 | 1.18 | 0 | 342 | 40 | 1.21 | 1 | 355 | 41 | 1.18 | Comp. |
| 13 | 1 | 418 | 38 | 1.76 | 5 | 412 | 39 | 1.78 | 0 | 413 | 39 | 1.78 | Inv. |
| 13 | 0 | 415 | 39 | 1.79 | 1 | 408 | 41 | 1.81 | 0 | 413 | 40 | 1.81 | Inv. |
| 18 | 1 | 358 | 45 | 1.8 | 0 | 358 | 45 | 1.81 | 0 | 360 | 44 | 1.79 | Inv. |
| 18 | 0 | 362 | 44 | 1.77 | 0 | 355 | 45 | 1.82 | 1 | 358 | 45 | 1.81 | Inv. |
| 20 | 0 | 355 | 44 | 1.33 | 2 | 350 | 45 | 1.47 | 1 | 355 | 44 | 1.44 | Comp. |
| 20 | 0 | 350 | 45 | 1.3 | 0 | 349 | 45 | 1.39 | 0 | 360 | 44 | 1.33 | Comp. |

As is apparent from Tables 31 to 34, the steels prepared according to the process of the present invention had excellent properties in the center portion of the coil, as well as in the portion at a distance of 10 m from the end. By contrast, for the comparative steels, the properties were remarkably deteriorated in positions nearer to end portion of the coil, and, in the case of coiling at low temperatures, the properties were very poor over the whole length of the coil. Evidently, this tendency is more significant in the position nearer to the end portion.

Example 11

The influence of the heating temperature in hot rolling on the properties of the materials after cold rolling and annealing was investigated using samples 2, 4, 11 and 19 (slabs tapped from an actual equipment) listed in Tables 16 to 19. The slabs were heated to 1000 to 1300° C. by means of an actual equipment and hot rolled under conditions of finishing temperature 940° C. and sheet thickness 4.0 mm. The average cooling rate on a run out table was about 20° C./sec, and the hot rolled steel strips were then coiled at 690° C. The whole length of the coil was about 200 m. Samples were taken off from the coil in the positions as described above in connection with Example 5, pickled, cold rolled to 0.8 mm, and subjected to heat treatment corresponding to continuous annealing in a laboratory. Annealing conditions were as follows. Annealing temp.: 790° C., soaking: 50 sec, cooling rate: 60° C./sec in cooling to room temp. Thereafter, the samples were temper rolled with a reduction ratio of 1.0% and used for a tensile test.

The test results are summarized in Tables 35 and 36 (continuation of Table 35).

TABLE 35

| | | 10 m from front end | | | | |
|---|---|---|---|---|---|---|
| Steel No. | Heating temp., ° C. | Content of C as carbide, ppm | TS, MPa | El, % | r | Remarks |
| 2 | 1000 | 0 | 317 | 49 | 1.89 | Inv. |
| 2 | 1100 | 0 | 324 | 49 | 1.87 | Inv. |
| 2 | 1150 | 3 | 333 | 47 | 1.8 | Inv. |
| 2 | 1200 | 3 | 335 | 47 | 1.78 | Inv. |
| 2 | 1250 | 5 | 341 | 43 | 1.49 | Comp. |
| 2 | 1300 | 9 | 348 | 41 | 1.32 | Comp. |
| 4 | 1000 | 0 | 288 | 52 | 1.81 | Inv. |
| 4 | 1100 | 2 | 296 | 50 | 1.79 | Inv. |
| 4 | 1150 | 2 | 297 | 49 | 1.77 | Inv. |
| 4 | 1200 | 4 | 302 | 48 | 1.7 | Inv. |
| 4 | 1250 | 5 | 307 | 45 | 1.51 | Comp. |
| 4 | 1300 | 7 | 310 | 41 | 1.21 | Comp. |
| 11 | 1000 | 0 | 352 | 45 | 1.79 | Inv. |
| 11 | 1100 | 0 | 362 | 44 | 1.73 | Inv. |
| 11 | 1150 | 0 | 366 | 44 | 1.7 | Inv. |
| 11 | 1200 | 2 | 374 | 43 | 1.67 | Inv. |
| 11 | 1250 | 5 | 358 | 41 | 1.34 | Comp. |
| 11 | 1300 | 7 | 388 | 39 | 1.23 | Comp. |
| 19 | 1000 | 0 | 354 | 45 | 1.83 | Inv. |
| 19 | 1100 | 1 | 358 | 45 | 1.8 | Inv. |
| 19 | 1150 | 1 | 362 | 44 | 1.77 | Inv. |
| 19 | 1200 | 3 | 369 | 43 | 1.73 | Inv. |
| 19 | 1250 | 5 | 359 | 41 | 1.42 | Comp. |
| 19 | 1300 | 8 | 380 | 39 | 1.3 | Comp. |

TABLE 36

(continuation of Table 35)

| | Center | | | | 10 in from rear end | | | | |
|---|---|---|---|---|---|---|---|---|---|
| No. | Content of C as carbide, ppm | TS, MPa | El, % | r | Content of C as carbide ppm | TS, MPa | El, % | r | Remarks |
| 2 | 0 | 315 | 50 | 1.92 | 0 | 317 | 51 | 1.9 | Inv. |
| 2 | 1 | 328 | 49 | 1.87 | 0 | 326 | 50 | 1.89 | Inv. |
| 2 | 1 | 331 | 48 | 1.8 | 1 | 329 | 47 | 1.8 | Inv. |
| 2 | 1 | 333 | 47 | 1.8 | 2 | 333 | 46 | 1.76 | Inv. |
| 2 | 2 | 342 | 44 | 1.52 | 4 | 340 | 43 | 1.5 | Comp. |
| 2 | 2 | 339 | 42 | 1.35 | 7 | 342 | 40 | 1.4 | Comp. |
| 4 | 0 | 287 | 52 | 1.84 | 0 | 82 | 53 | 1.82 | Inv. |
| 4 | 1 | 295 | 50 | 1.79 | 0 | 285 | 50 | 1.78 | Inv. |
| 4 | 0 | 297 | 49 | 1.76 | 1 | 291 | 50 | 1.75 | Inv. |
| 4 | 1 | 301 | 48 | 1.72 | 3 | 299 | 49 | 1.73 | Inv. |
| 4 | 1 | 132 | 45 | 1.53 | 5 | 309 | 46 | 1.55 | Comp. |
| 4 | 2 | 315 | 42 | 1.24 | 6 | 312 | 41 | 1.29 | Comp. |
| 11 | 0 | 350 | 46 | 1.82 | 0 | 352 | 45 | 1.81 | Inv. |
| 11 | 1 | 357 | 45 | 1.71 | 0 | 360 | 45 | 1.73 | Inv. |
| 11 | 1 | 362 | 45 | 1.69 | 2 | 363 | 44 | 1.71 | Inv. |
| 11 | 0 | 369 | 44 | 1.64 | 5 | 370 | 44 | 1.66 | Inv. |
| 11 | 1 | 376 | 42 | 1.6 | 6 | 381 | 41 | 1.32 | Comp. |
| 11 | 2 | 382 | 40 | 1.52 | 9 | 387 | 38 | 1.17 | Comp. |
| 19 | 0 | 350 | 46 | 1.85 | 0 | 354 | 45 | 1.82 | Inv. |
| 19 | 0 | 358 | 45 | 1.81 | 0 | 360 | 44 | 1.79 | Inv. |
| 19 | 1 | 360 | 44 | 1.69 | 1 | 363 | 45 | 1.73 | Inv. |
| 19 | 1 | 367 | 44 | 1.72 | 3 | 368 | 43 | 1.7 | Inv. |
| 19 | 1 | 380 | 42 | 1.6 | 7 | 384 | 40 | 1.3 | Comp. |
| 19 | 1 | 384 | 39 | 1.54 | 9 | 385 | 37 | 1.15 | Comp. |

As is apparent from Tables 35 and 36, the steels prepared according to the process of the present invention had excellent properties after cold rolling and annealing in the center portion of the hot rolled coil, as well as in the end portions. By contrast, when the heating temperature was above 1200° C., the properties after cold rolling and annealing were remarkably deteriorated in the end portions of the coil.

Example 12

Steel Nos. 4, 5, 11, 12, 22 and 23 listed in Tables 16 to 19 were hot rolled in the same manner as in Table 37, subsequently pickled using an actual equipment, cold rolled with a reduction ratio of 80%, and passed through a continuous galvanizing line of in-line annealing system. Plating conditions used in this case are given in Table 37. Temper rolling was carried out with reduction ratios as indicated in Table 37 and evaluated for mechanical properties and adhesion of plating. The results are summarized in Table 23 (continuation of Table 22).

Regarding the adhesion of plating, a sample was bent at 180° C. to close contact, and the peeling of the zinc coating was judged by adhering a pressure-sensitive tape to the bent portion and then peeling the tape, and determining the amount of the peeled plating adhered to the tape. The adhesion of plating was evaluated based on the following five grades.

1: large peeling, 2: medium peeling, 3: small peeling, 4: very small peeling, and 5: no peeling.

TABLE 37

| Steel No. | Rolling conditions: Heating temp., ° C. | Finishing temp., ° C. | Cooling rate, ° C./sec | Coiling temp., ° C. | Plating conditions Max. heating temp. → plating temp. (Al concentration of bath) → alloying temp. × time | Temper rolling reduction ratio, % | Remarks |
|---|---|---|---|---|---|---|---|
| 4 | 1080 | 910 | 20 | 710 | 820° C. → 470° C.(0.14%) → 570° C. × 15s | 0.8 | Inv. |
| 5 | 1080 | 910 | 20 | 710 | 820° C. → 470° C.(0.14%) → 570° C. × 15s | 0.8 | Comp. |
| 11 | 1080 | 940 | 30 | 720 | 830° C. → 460° C.(0.12%) → 630° C. × 10s | 0.7 | Inv. |
| 12 | 1080 | 940 | 30 | 710 | 830° C. → 460° C.(0.12%) → 630° C. × 10s | 0.7 | Comp. |
| 22 | 1120 | 950 | 20 | 730 | 800° C. → 460° C.(0.13%) → 610° C. × 10s | 0.8 | Inv. |
| 23 | 1120 | 950 | 20 | 730 | 800° C. → 460° C.(0.13%) → 610° C. × 10s | 0.8 | Comp. |

TABLE 38

(Continuation of Table 37)

| | 10 m from front end | | | | Center | | | | 10 m from rear end | | | | |
|---|---|---|---|---|---|---|---|---|---|---|---|---|---|
| No. | TS, MPa | El, % | r | Plating adhesion | TS, MPa | El, % | r | Plating adhesion | TS, MPa | El, % | r | Plating adhesion | Remarks |
| 4 | 308 | 46 | 1.61 | 5 | 308 | 47 | 1.63 | 5 | 309 | 46 | 1.62 | 5 | Inv. |
| 5 | 321 | 43 | 1.29 | 4 | 315 | 45 | 1.5 | 4 | 317 | 44 | 1.3 | 4 | Comp. |
| 11 | 366 | 44 | 1.61 | 5 | 357 | 45 | 1.62 | 5 | 360 | 44 | 1.59 | 5 | Inv. |
| 12 | 360 | 43 | 1.17 | 4 | 354 | 44 | 1.59 | 4 | 362 | 43 | 1.24 | 3 | Comp. |
| 22 | 461 | 33 | 1.61 | 5 | 460 | 34 | 1.64 | 5 | 462 | 32 | 1.62 | 4 | Inv. |
| 23 | 467 | 30 | 1.13 | 3 | 465 | 33 | 1.42 | 4 | 466 | 31 | 1.2 | 4 | Comp. |

As is apparent from Tables 37 and 38, the alloyed, galvanized steel sheets according to the process of the present invention had excellent properties independently of sites on the coils. By contrast, for the comparative steels, a variation in workability was observed from site to site.

INDUSTRIAL APPLICABILITY

As described above, according to the present invention, the coiling temperature after hot rolling can be decreased, and properties homogeneous in the longitudinal direction and the widthwise direction of the coil can be provided, enabling the end portions of the coil, which have been cut off in the prior art, to be used as a product. Further, when the application of high-strength cold rolled steel sheets covered by the present invention to automobiles is contemplated, since the sheet thickness can be reduced, the fuel consumption can be reduced, contributing to alleviation of environmental problems. Thus, the present invention is very valuable.

We claim:

1. A process for producing a cold rolled steel sheet possessing improved homogeneity in workability, comprising the steps of:

heating a steel sheet, consisting essentially of by weight C: 0.0005 to 0.007%, Mn: 0.01 to less than 0.10%, Si: 0.005 to 0.8%, Al: 0.005 to 0.1%, P: not more than 0.2%, S: 0.007 to 0.02%, N: not more than 0.007%, and Nb: 0.005 to 0.1% with the balance consisting of iron and unavoidable impurities, at a temperature of less than 1050° C.;

hot-rolling the heated steel sheet at a finishing temperature of ($Ar_3$—100)° C. or above and during said hot rolling, precipitating Nb-containing carbosulfides in a γ region thereby minimizing solid solution C content prior to coiling;

coiling the hot rolled steel strip in the temperature range of from 800° C. to room temperature;

cold-rolling the hot rolled steel strip with a reduction ratio of not less than 60%; and then annealing the cold rolled steel strip at the recrystallization temperature or above;

wherein the proportion of the amount of S precipitated as MnS to the S content of the steel sheet: K=(% S as MnS)/(S content) is not more than 0.2 and the proportion of the amount of C precipitated as Nb-containing carbosulfide to the C content of the steel sheet : L=(% C as carbosulfide)/(C content) is not less than 0.7.

2. The process for producing a cold rolled steel sheet according to claim 1, wherein the steel sheet as the starting material has a Nb content of 0.002 to 0.05% by weight and further consists essentially of Ti: 0.01 to 0.1% by weight;

said process further comprising precipitating Ti-containing carbosulfides in a γ region during said hot rolling step thereby further minimizing solid solution C content prior to coiling.

3. The process for producing a cold rolled steel sheet according to claim 1, wherein the steel sheet as the starting material further comprises B: 0.0001 to 0.0030% by weight.

4. A process according to claim 1 further comprising:

feeding the cold rolled steel strip into a continuous galvanizing line comprising an annealing furnace, a cooling system and a galvanizing tank, with said annealing of said cold rolled steel strip taking place at said recrystallization temperature or above, cooling said annealed steel strip; and galvanizing the cooled annealed steel strip.

5. The process for producing a galvanized cold rolled steel sheet according to claim 4, wherein the as-galvanized steel strip is alloyed in the temperature range of from 400 to 600° C.

6. A process for producing a cold rolled steel sheet possessing improved homogeneity in workability, comprising the steps of:

heating a steel sheet, consisting essentially of by weight C: 0.0005 to 0.007%, Mn: 0.01 to less than 0.10%, Si: 0.005 to 0.8%, Al: 0.005 to 0.1%, P: not more than 0.2%, S: 0.007 to 0.02%, N: not more than 0.007%, and Ti: 0.01 to 0.1% while satisfying $Ti^*/S \geqq 1.5$ wherein $Ti^*=Ti-3.42\ N$, with the balance consisting of iron and unavoidable impurities, at a temperature of less than 1150° C.;

hot-rolling the heated steel sheet at a finishing temperature of $(Ar_3—100)$° C. or above and during said hot rolling, precipitating Ti-containing carbosulfides in a γ region thereby minimizing solid solution C content prior to coiling;

coiling the hot rolled steel strip in the temperature range of from 800° C. to room temperature;

cold-rolling the hot rolled steel strip with a reduction ratio of not less than 60%; and then annealing the cold-rolled steel strip at the recrystallization temperature or above;

wherein the proportion of the amount of S precipitated as MnS to S content of the steel sheet: K=(% S as MnS)/(S content) is not more than 0.2.

7. The process for preparing a cold rolled steel sheet according to claim 6, wherein the steel sheet as the starting material further comprises B: 0.0001 to 0.0030% by weight.

8. A process according to claim 6 further comprising:

feeding the cold rolled steel strip into a continuous galvanizing line comprising an annealing furnace, a cooling system and a galvanizing tank, with said annealing of said cold rolled steel strip taking place at said recrystallization temperature or above, cooling said annealed steel strip; and galvanizing the cooled annealed steel strip.

9. The process for producing a galvanized cold rolled steel sheet according to claim 8, wherein the as-galvanized steel strip is alloyed in the temperature range of from 400 to 600° C.

* * * * *